US011391505B2

(12) United States Patent
Yoon et al.

(10) Patent No.: US 11,391,505 B2
(45) Date of Patent: Jul. 19, 2022

(54) REFRIGERATOR

(71) Applicant: SAMSUNG ELECTRONICS CO., LTD., Suwon-si (KR)

(72) Inventors: Seok Jun Yoon, Suwon-si (KR); Jin Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/972,050

(22) PCT Filed: May 9, 2019

(86) PCT No.: PCT/KR2019/005528

§ 371 (c)(1),
(2) Date: Dec. 4, 2020

(87) PCT Pub. No.: WO2019/235747

PCT Pub. Date: Dec. 12, 2019

(65) Prior Publication Data

US 2021/0239386 A1 Aug. 5, 2021

(30) Foreign Application Priority Data

Jun. 8, 2018 (KR) ..... 10-2018-0066276

(51) Int. Cl.
*F25D 23/00* (2006.01)
*F25D 23/02* (2006.01)
(Continued)

(52) U.S. Cl.
CPC ..... *F25D 23/028* (2013.01); *E05C 3/124* (2013.01); *E05C 3/16* (2013.01); *F25D 23/04* (2013.01);
(Continued)

(58) Field of Classification Search
CPC ..... F25D 23/028; F25D 23/025; F25D 2323/023; E05C 3/124; E05C 3/16; E05B 65/0042
See application file for complete search history.

(56) References Cited

U.S. PATENT DOCUMENTS 9,267,727 B2 * 2/2016 Lim ..... F25D 23/00
9,410,732 B2 * 8/2016 Choi ..... F25D 23/025
(Continued)

FOREIGN PATENT DOCUMENTS

DE 102015222228 * 5/2017
KR 20-1998-052427 U 10/1998
(Continued)

OTHER PUBLICATIONS

Extended European Search Report dated Jun. 18, 2021, in EP Application No. 19814899.
(Continued)

*Primary Examiner* — Janet M Wilkens
(74) *Attorney, Agent, or Firm* — Staas & Halsey LLP

(57) ABSTRACT

The present disclosure relates to a refrigerator including a latch device configured to couple or separate the second door to or from the first door, wherein the latch device includes a fixing member disposed on the first door, a locking member provided on the second door to be coupled or separated from the fixing member, and an input member provided on the second door to be rotatable in the left and right directions, and wherein the locking member rotates in a direction of being separated from the fixing member when the input member rotates in the left direction, and the locking member rotates in the direction of being separated from the fixing member when the input member rotates in the right direction.

20 Claims, 19 Drawing Sheets

(51) Int. Cl.

| | |
|---|---|
| ***E05C 3/12*** | (2006.01) |
| ***E05C 3/16*** | (2006.01) |
| ***F25D 23/04*** | (2006.01) |

(52) U.S. Cl.
CPC ..... *E05Y 2900/31* (2013.01); *F25D 23/025* (2013.01); *F25D 2323/023* (2013.01)

(56) References Cited

U.S. PATENT DOCUMENTS

| | | | | |
|---|---|---|---|---|
| 9,518,777 | B2 * | 12/2016 | Lee | F25D 23/00 |
| 9,759,477 | B2 * | 9/2017 | Lee | F25D 23/028 |
| 10,234,190 | B2 * | 3/2019 | Wantland | F25D 23/025 |
| 2008/0296915 | A1 | 12/2008 | Clark et al. | |
| 2014/0202220 | A1 * | 7/2014 | Denison | E05B 65/0811 70/267 |
| 2015/0069900 | A1 * | 3/2015 | Lim | F25D 23/025 312/405 |
| 2015/0176886 | A1 * | 6/2015 | Lee | F25D 23/00 312/404 |
| 2015/0260443 | A1 | 9/2015 | Lee et al. | |
| 2017/0175423 | A1 * | 6/2017 | Gresham, IV | F25D 23/066 |
| 2018/0156529 | A1 * | 6/2018 | Wantland | F25D 23/087 |
| 2019/0331400 | A1 * | 10/2019 | Park | F25D 23/025 |
| 2019/0338999 | A1 * | 11/2019 | Lee | E05B 65/06 |
| 2021/0148626 | A1 * | 5/2021 | Cooper | E05B 1/0038 |

FOREIGN PATENT DOCUMENTS

| | | | |
|---|---|---|---|
| KR | 10-2011-0044034 | A | 4/2011 |
| KR | 10-2013-0053318 | A | 5/2013 |
| KR | 10-2015-0106311 | A | 9/2015 |
| KR | 10-2015-0124223 | A | 11/2015 |
| KR | 10-2016-0017017 | | 2/2016 |

OTHER PUBLICATIONS

International Search Report dated Aug. 22, 2019, in corresponding International Patent Application No. PCT/KR2019/005528.

* cited by examiner

REFRIGERATOR

CROSS-REFERENCE TO RELATED APPLICATIONS

This application is a U.S. National Stage Application which claims the benefit under 35 U.S.C. § 371 of International Patent Application No. PCT/KR2019/005528 filed on May 9, 2019, which claims foreign priority benefit under 35 U.S.C. § 119 of Korean Patent Application 10-2018-0066276 filed on Jun. 8, 2018, in the Korean Intellectual Property Office, the contents of both of which are incorporated herein by reference.

TECHNICAL FIELD

The present disclosure relates to a refrigerator, and more particularly, to a refrigerator including a door provided with a latch device.

BACKGROUND ART

Generally, a refrigerator is an appliance that keeps food fresh by including a main body provided with a storage compartment therein and a cold air supply system for supplying cold air to the storage compartment. The storage compartment includes a refrigerating compartment that is maintained at temperature of about 0 degrees Celsius to 5 degrees Celsius to keep food refrigerated, and a freezing compartment that is maintained at temperature of about 0 degrees Celsius to −30 degrees Celsius to keep food frozen.

The storage compartment is provided with shelves to store food. The storage compartment is provided with an open front to allow food to be put in and taken out, and the open front of the storage compartment may be opened and closed by a first door rotatably coupled to the main body. A rear surface of the first door may be provided with a door pocket for storing food separately from the shelves arranged in the storage compartment.

Because the door pocket is provided on the rear surface of the first door, generally, the first door needs to be opened to access the door pocket. On the other hand, there is a refrigerator having a separate second door on the first door so that the door pocket may be accessed without opening the first door. A refrigerator having such a second door may allow access to the door pocket provided on the rear surface of the first door by opening only the second door without opening the first door, so that the diversity of food storage may be increased and the effect of preserving cold air may be obtained.

DISCLOSURE

Technical Problem

The present disclosure is directed to providing a refrigerator capable of easily opening a door.

The present disclosure is directed to providing a refrigerator in which a latch device may be easily installed on a door.

Technical Solution

One aspect of the present disclosure provides a refrigerator including a main body including a storage compartment, a first door disposed in front of the main body and having an opening, a second door disposed in front of the first door to open and close the opening of the first door, and a latch device configured to couple or separate the second door to or from the first door, wherein the latch device includes a fixing member disposed on the first door, a locking member provided on the second door to be coupled or separated from the fixing member, and an input member provided on the second door to be rotatable in the left and right directions, and wherein the locking member rotates in a direction of being separated from the fixing member when the input member rotates in the left direction, and the locking member rotates in the direction of being separated from the fixing member when the input member rotates in the right direction.

The latch device may further include a latch case disposed on the second door, the locking member may be coupled to the latch case to be rotatable with respect to a first rotation axis, and the input member may be coupled to the latch case to be rotatable with respect to a second rotation axis.

The locking member may include a locking protrusion formed at one end close to the fixing member and a receiving protrusion formed at the other end close to the input member, and the input member may include a first pressing portion configured to press the receiving protrusion when the input member rotates in the right direction and a second pressing portion configured to press the receiving protrusion when the input member rotates in the left direction.

The receiving protrusion may include a receiving roller rotatably provided on a portion coming into contact with the first pressing portion or the second pressing portion.

At least one of the first pressing portion and the second pressing portion may include an input roller rotatably provided on a portion coming into contact with the receiving protrusion when the input member rotates.

The latch device may further include an elastic member configured such that one end thereof is fixed to the latch case and the other end opposite to the one end is fixed to the locking member to press the locking member in a direction of being coupled to the fixing member.

The second door may further include a latch cover forming an accommodation space in which at least a portion of the latch case is accommodated.

The latch case may include a cover portion to cover the accommodation space of the latch cover.

The cover portion may be formed to cover a portion of the second door to which the latch cover is coupled.

The cover portion may include a through hole formed in a size and shape corresponding to the input member so that the input member passes therethrough.

The latch case may be provided to be screwed to at least one of the latch cover and the second door.

The first rotation axis may extend in a direction different from the second rotation axis.

The first rotation axis may extend in a direction perpendicular to the second rotation axis.

The refrigerator may further include a door handle installed on the second door and disposed in front of the latch device to be spaced apart from the latch device.

The input member may be disposed to protrude from a front surface of the second door.

Another aspect of the present disclosure provides a refrigerator including a main body including a storage compartment, a first door disposed in front of the main body and having an opening, a second door disposed in front of the first door to open and close the opening of the first door, and a latch device, wherein the latch device includes a fixing member disposed on the first door, a latch case disposed on the second door, a locking member coupled to the latch case to be rotatable with respect to a first rotation axis and including a locking protrusion provided at one end to be coupled to or separated from the fixing member and a receiving portion provided at the other end opposite to the one end, an input member slidably coupled to the latch case and including a connection portion connected to the receiving portion of the locking member to rotate the locking member, wherein the connection portion includes an inclined portion to correspond to a rotation range of the receiving portion.

The latch case may include a rib extending along a sliding direction of the input member.

The latch device may further include an elastic member configured to press the input member in a direction of being withdrawn from the latch case, and the elastic member may be disposed at the center on a plane perpendicular to the sliding direction of the input member.

The input member may further include a limiting protrusion being interfered by the latch case to limit a range in which the input member is withdrawn from the latch case.

Another aspect of the present disclosure provides a refrigerator including a main body including a storage compartment, a first door disposed in front of the main body to open and close the storage compartment, and a latch device, wherein the latch device includes a fixing member disposed on the main body, a latch case disposed on the door, a locking member coupled to the latch case to be rotatable with respect to a first rotation axis extending along the left and right directions and configured to be coupled to or separated from the fixing member, and an input member coupled to the latch case to be rotatable with respect to a second rotation axis extending along the up and down directions, wherein the input member is configured to rotate the locking member in a direction of being separated from the fixing member when rotating in a first direction and to rotate the locking member in the direction of being separated from the fixing member even when rotating in a second direction opposite to the first direction.

Advantageous Effects

In a refrigerator according to an embodiment of the present disclosure, a locking member is released from a fixing member when an input member rotates in the right direction as well as to the left direction, so that a door can be easily opened.

In the refrigerator according to an embodiment of the present disclosure, a latch device is configured as one assembly, so that the latch device can be easily installed on the door.

MODE OF THE DISCLOSURE

Figure 1:
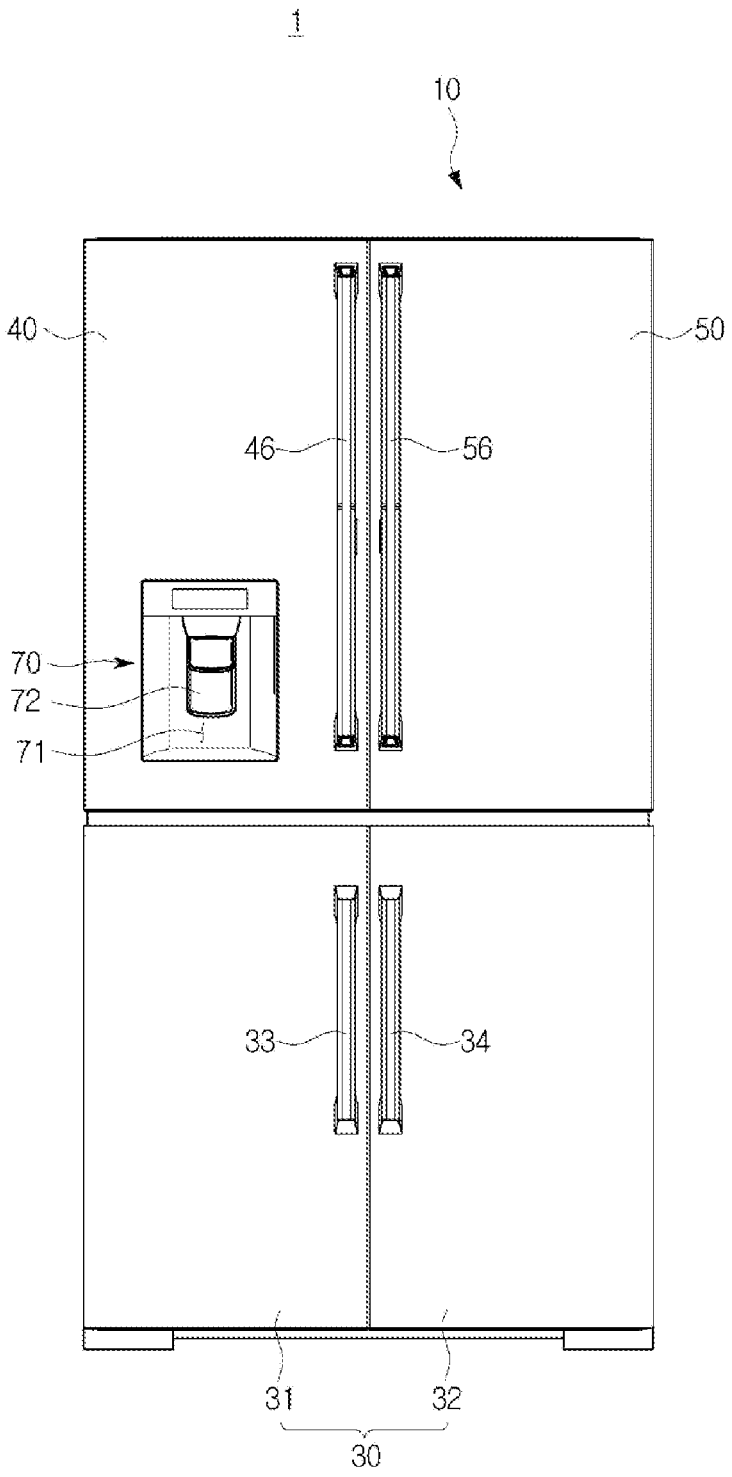
FIG. 1 is a front view of a refrigerator according to an embodiment of the present disclosure, illustrating a state in which all first doors and second doors are closed.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and has are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front," "rear," "upper portion," "lower portion," "left," and "right" used in the following description are defined with reference to the drawings, and the shape and position of each component are not limited by these terms.

Hereinafter, embodiments of the present disclosure will be described in detail with reference to the accompanying drawings.

Figure 2:
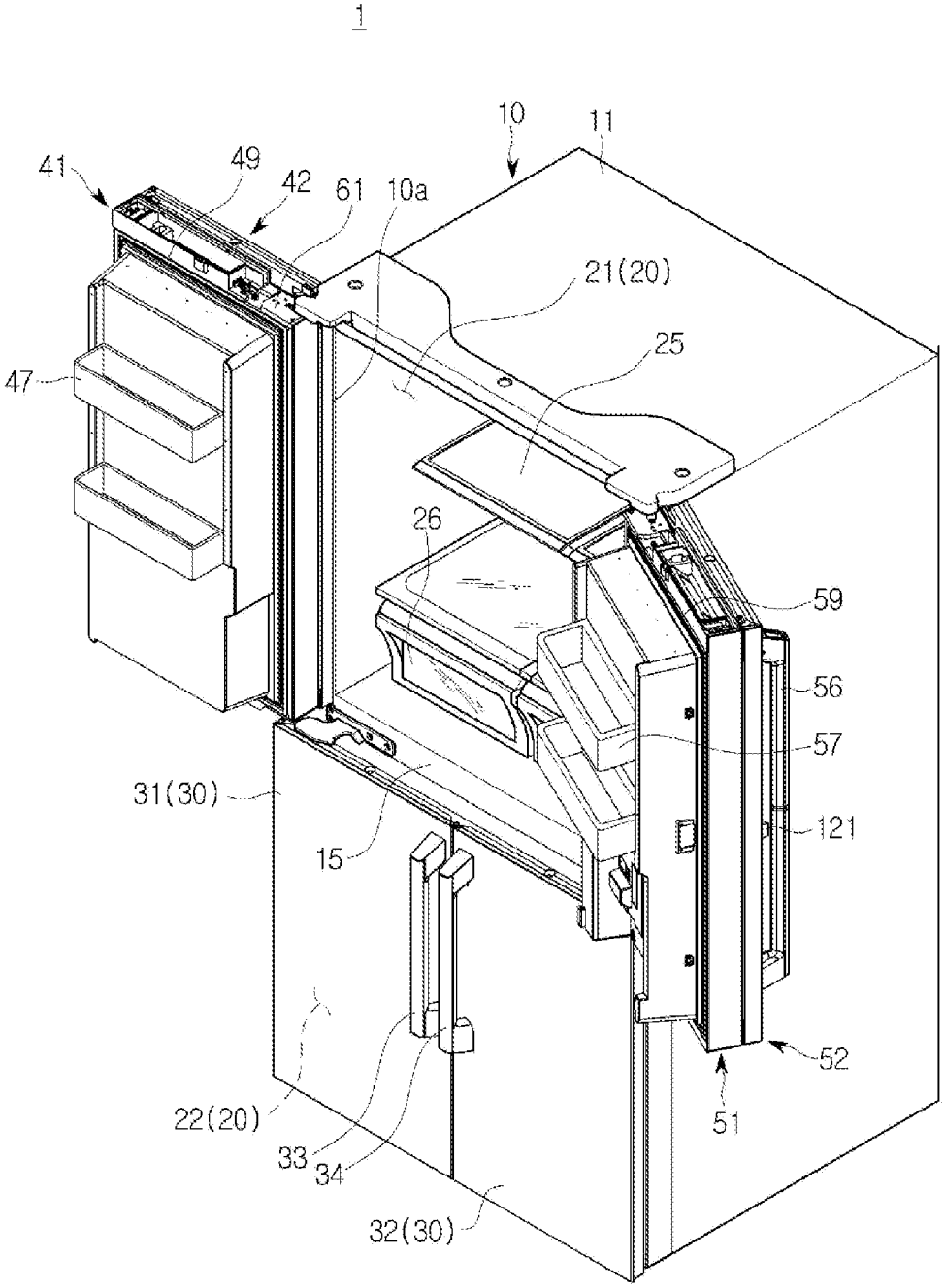
FIG. 2 illustrates a state in which all the first doors and the second doors of the refrigerator illustrated in FIG. 1 are opened.
Figure 3:
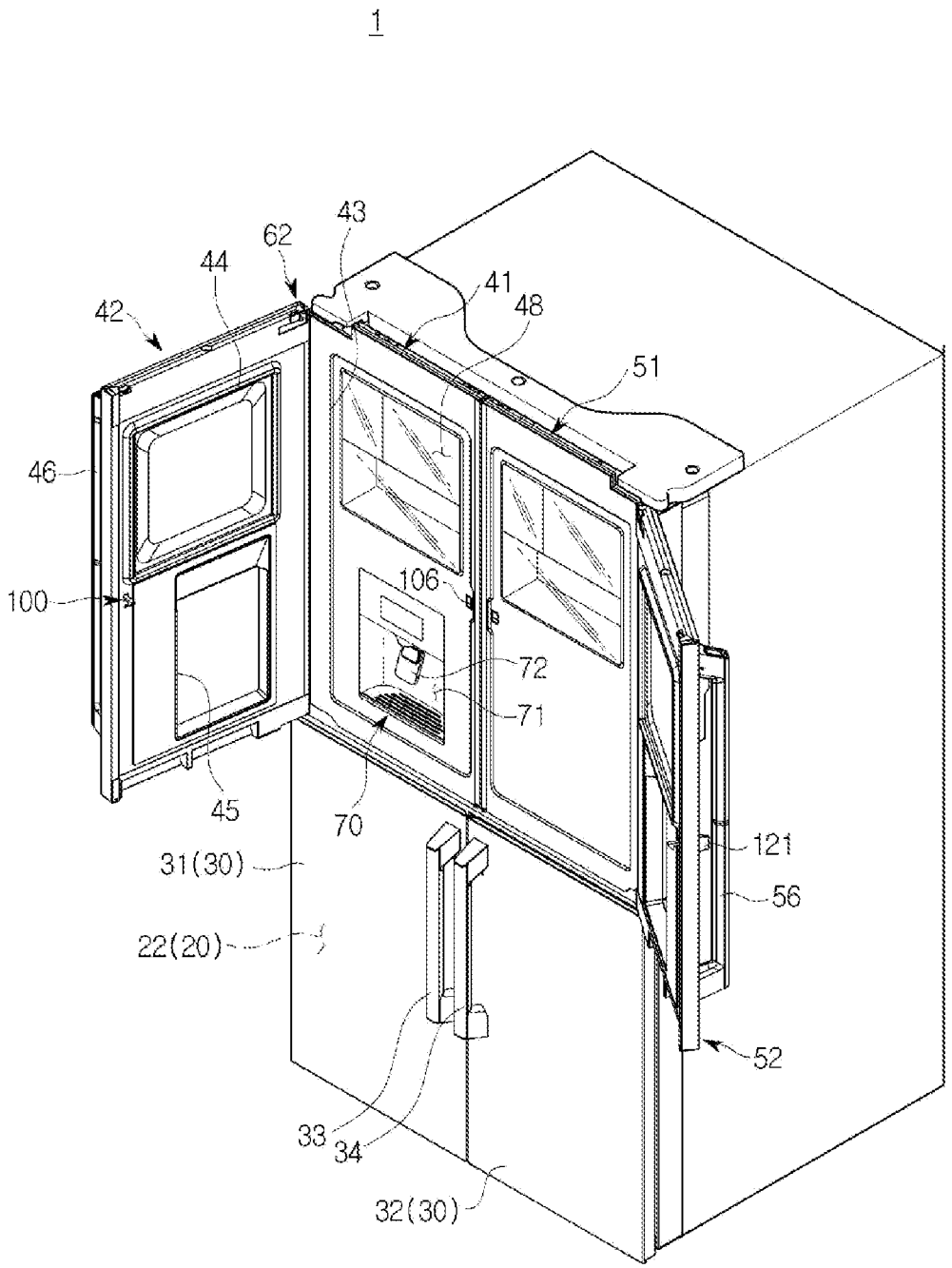
FIG. 3 illustrates a state in which the first doors of the refrigerator illustrated in FIG. 1 are closed and only the second doors are opened.

FIG. 1 is a front view of a refrigerator 1 according to an embodiment of the present disclosure, illustrating a state in which all first doors 41 and 51 and second doors 42 and 52 are closed. FIG. 2 illustrates a state in which all the first doors 41 and 51 and the second doors 42 and 52 of the refrigerator 1 illustrated in FIG. 1 are opened. FIG. 3 illustrates a state in which the first doors 41 and 51 of the refrigerator 1 illustrated in FIG. 1 are closed and only the second doors 42 and 52 are opened.

The refrigerator 1 may include a main body 10, a storage compartment 20 formed by being partitioned up and down inside the body 10, door 30, 40, and 50 configured to open and close the storage compartment 20, and a cold air supply device (not shown) configured to supply cold air to the storage compartment 20.

The main body 10 may include an inner case (not shown) forming the storage compartment 20, an outer case 11 coupled to an outer side of the inner case to form an outer appearance, and an insulator foamed between the inner case and outer case 11 to insulate the storage compartment 20.

The cold air supply device may generate cold air using a cooling circulation cycle in which a refrigerant is compressed, condensed, expanded, and evaporated.

The storage compartment 20 may be partitioned by a partition 15. A plurality of shelves 25 and storage containers 26 may be provided inside the storage compartment 20 to store food.

The storage compartment 20 may be divided into a plurality of storage compartments 21 and 22 by the partition 15. The partition 15 may be disposed horizontally inside the storage compartment 20 to divide the storage compartment 20 into the upper storage compartment 21 and the lower storage compartment 22. Although not shown, the partition 15 may include a lower partition (not shown) vertically disposed in the lower storage compartment 22 to divide the lower storage compartment 22 into a first lower storage compartment (not shown) and a second lower storage compartment (not shown).

The upper storage compartment 21 of the upper storage compartment 21 and the lower storage compartment 22 divided by the partition 15 may be used as a refrigerating compartment, and the lower storage compartment 22 may be used as a freezing compartment. Conversely, in the refrigerator 1 of the present disclosure, the upper storage compartment 21 may be used as a freezing compartment, and the lower storage compartment 22 may be used as a refrigerating compartment. The division of the storage compartment 20 described above is only an example, and each of the storage compartments 21 and 22 may be used differently from the above configuration.

The upper storage compartment 21 may be opened and closed by a pair of upper door devices 40 and 50 rotatably coupled to the main body 10. The pair of upper door devices 40 and 50 may include the upper left door 40 and the upper right door 50. The upper left door 40 may include an upper left door handle 46. The upper right door 50 may include an upper right door handle 56. The upper left door handle 46 may be provided on the second left door 42. The upper right door handle 56 may be provided on the second right door 52.

The lower storage compartment 22 may be opened and closed by a pair of lower door devices 30 rotatably coupled to the main body 10. The pair of lower door devices 30 may include a lower left door 31 and a lower right door 32. The lower left door 31 may include a lower left door handle 33. The lower right door 32 may include a lower right door handle 34.

Alternatively, the doors for opening and closing the lower storage compartment 22 may be configured to be driven in a sliding manner.

The pair of upper door devices 40 and 50 and the pair of lower door devices 30 may open and close a main body opening 10*a* of the main body 10.

An upper left door shelf 47 capable of storing food may be provided on a rear surface of the upper left door 40. An upper right door shelf 57 capable of storing food may be provided on a rear surface of the upper right door 50. A lower left door shelf (not shown) capable of storing food may be provided on a rear surface of the lower left door 31. A lower right door shelf (not shown) capable of storing food may be provided on a rear surface of the lower right door 32.

An upper left gasket 49 may be provided at an edge of the rear surface of the upper left door 40 to seal a gap with the main body 10 in a state in which the upper left door 40 is closed. The upper left gasket 49 may be installed in the form of a loop along the edge of the rear surface of the upper left door 40. A magnet (not shown) may be provided inside the upper left gasket 49. An upper right gasket 59 may be provided at an edge of the rear surface of the upper right door 50 to seal a gap with the main body 10 in a state in which the upper right door 50 is closed. The upper right gasket 59 may be installed in the form of a loop along the edge of the rear surface of the upper right door 50. A magnet (not shown) may be provided inside the upper right gasket 59. A lower left gasket (not shown) may be provided at an edge of the rear surface of the lower left door 31 to seal a gap with the main body 10 in a state in which the lower left door 31 is closed. The lower left gasket may be installed in the form of a loop along the edge of the rear surface of the lower left door 31. A magnet (not shown) may be provided inside the lower left gasket. A lower right gasket (not shown) may be provided at an edge of the rear surface of the lower right door 32 to seal a gap with the main body 10 in a state in which the lower right door 32 is closed. The lower right gasket may be installed in the form of a loop along the edge of the rear surface of the lower right door 32. A magnet (not shown) may be provided inside the lower right gasket.

Hereinafter, for convenience of explanation, only the upper left door 40 will be described, and the upper left door 40 will be referred to as the door device 40. Also, the upper left door handle 46 will be referred to as the door handle 46, the upper left door shelf 47 will be referred to as the door shelf 47, and the upper left gasket 49 will be referred to as the first gasket 49. However, the door device 40, which will be described below, may be applied to the upper right door 50 and may be applied to at least one of the pair of lower door devices 30.

The door device 40 may be provided as a double door including the first door 41 and the second door 42.

The first door 41 may be rotatably connected to the main body 10 by a first hinge unit 61. The first door 41 may be disposed in front of the main body 10. The first door 41 may cover a portion of the main body opening 10*a* of the main body 10. The door shelf 47 and the first gasket 49 may be provided on the first door 41.

The first door 41 may include a door opening 43 formed to allow a user to access a door storage compartment 48 and put or take food in or out in a state in which the first door 41 is closed. The door opening 43 is formed to penetrate the first door 41 and may be opened and closed by the second door 42.

A dispenser 70 capable of dispensing purified water, carbonated water, or ice from the outside without opening the door device 40 may be provided on the first door 41. The dispenser 70 may include a dispensing space 71 in which purified water, carbonated water, or ice may be taken out, and a lever 72 capable of selecting whether to take out or not.

The second door 42 may be disposed in front of the first door 41 to open and close the door opening 43 of the first door 41. The second door 42 may be provided to be rotatable in the same direction as the second door 41. The present embodiment exemplifies that the second door 42 is rotatably supported on a second hinge unit 62 installed on the first door 41 to be rotatable with respect to the first door 41, but is not limited thereto, and the second hinge unit 62 may be installed on the main body 10 so that the second door 42 may be provided to be rotatable with respect to the main body 10.

The second door 42 may include the door handle 46 formed to be gripped by a user. The door handle 46 may be provided at the other end opposite to one end of the second door 42 connected to the second hinge unit 62. The door handle 46 may extend by a predetermined length in the up and down directions. Upper and lower end portions of the door handle 46 may be fixed to the second door 42, respectively, and the remaining portion of the door handle 46 between the upper and lower end portions may be formed to be spaced apart from the second door 42. Accordingly, the user may grip the door handle 46 through a space between the second door 42 and the door handle 46.

The second door 42 may include a second gasket 44 for maintaining airtightness with the first door 41. The second gasket 44 may be installed in the form of a roof on a rear surface of the second door 42. The second gasket 44 may be disposed to correspond to the door opening 43 of the first door 41. A magnet (not shown) may be provided in the second gasket 44.

A dispenser opening 45 for exposing the dispenser 70 provided on the first door 41 to the outside may be formed on the second door 42.

Figure 4:
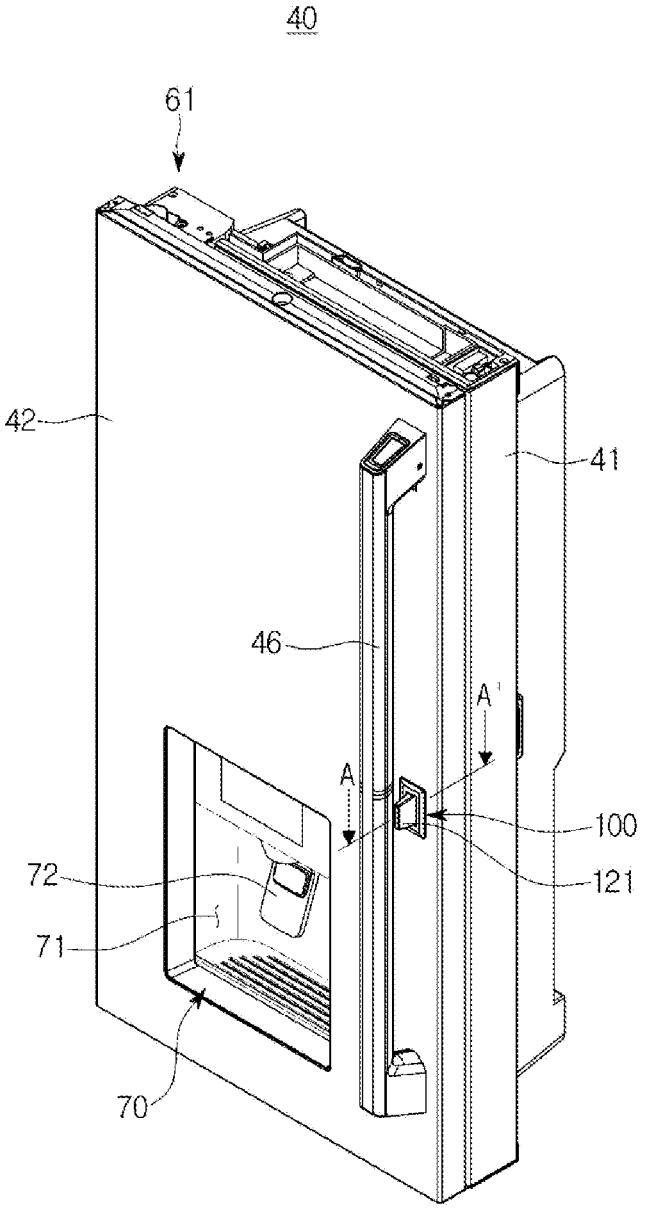
FIG. 4 illustrates a door device of the refrigerator illustrated in FIG. 1.
Figure 5:
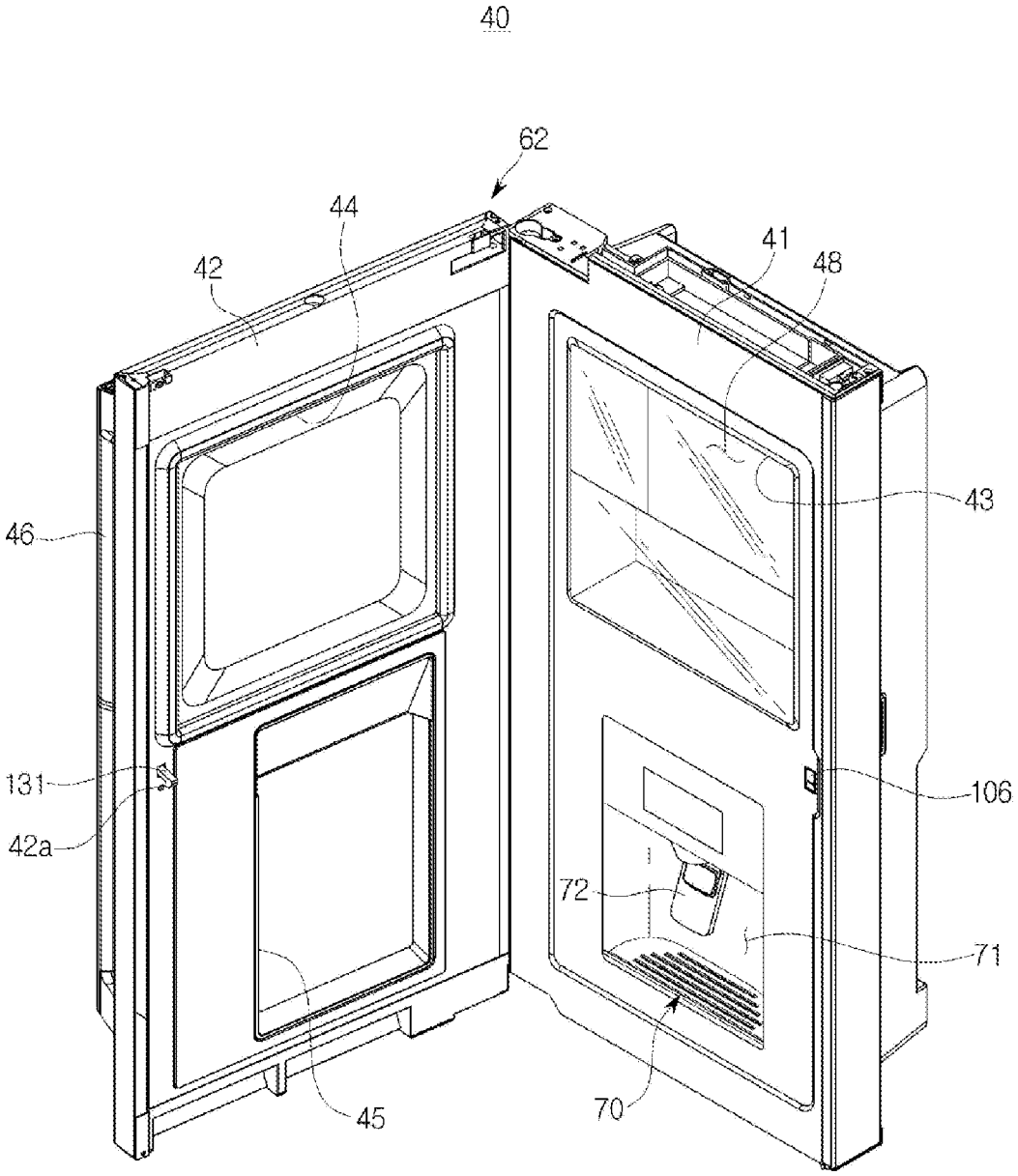
FIG. 5 illustrates a state in which the second door of the door device of the refrigerator illustrated in FIG. 4 is opened.
Figure 6:
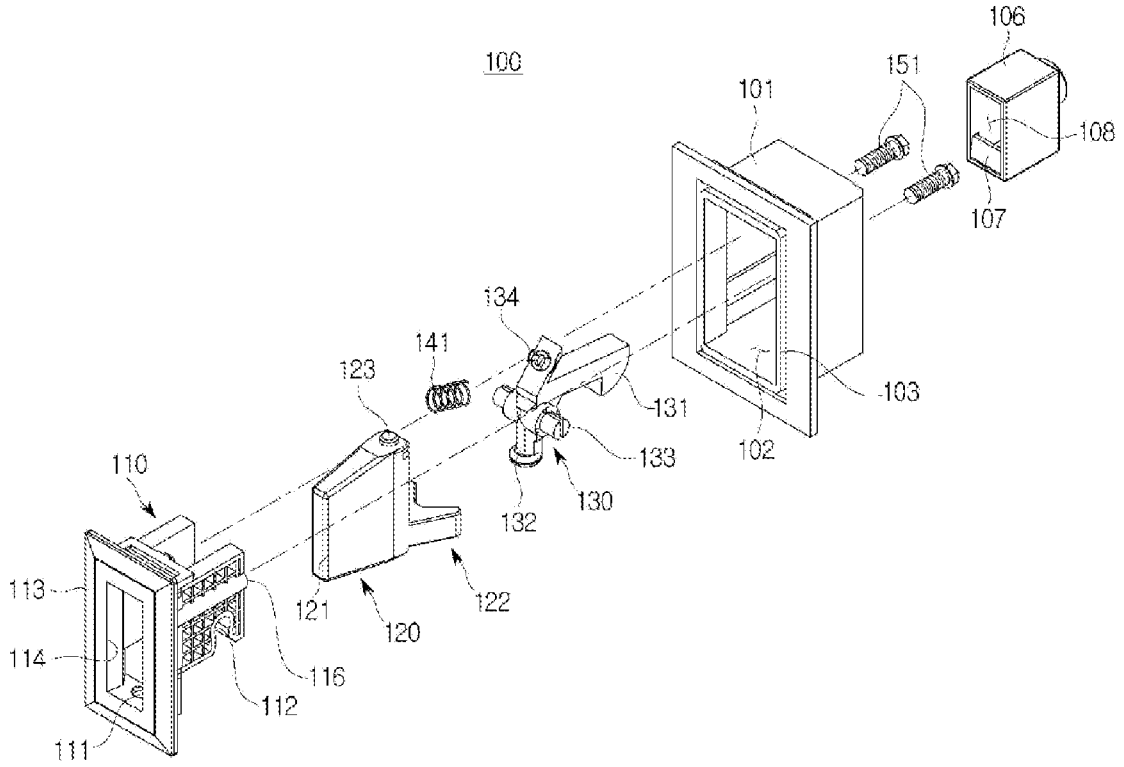
FIG. 6 is an exploded perspective view of a latch device provided in the door device illustrated in FIG. 4.
Figure 7:
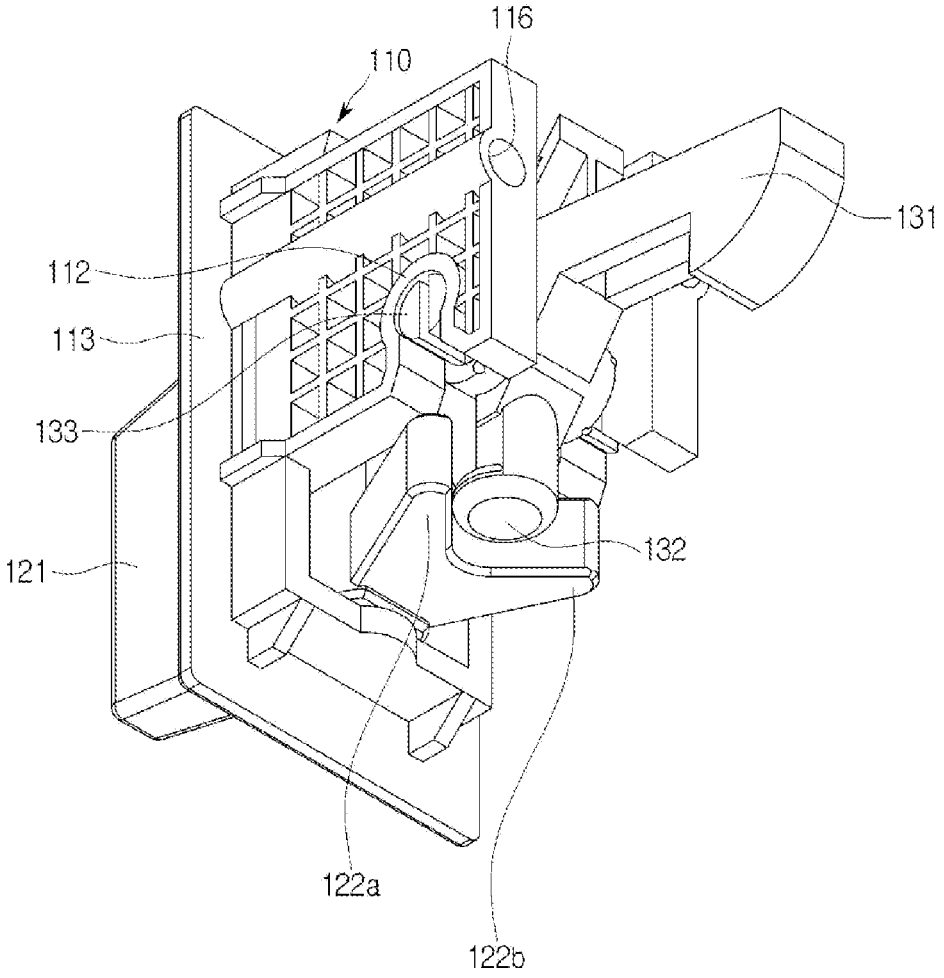
FIG. 7 is a rear lower perspective view of a partial configuration of the latch device illustrated in FIG. 6.
Figure 8:
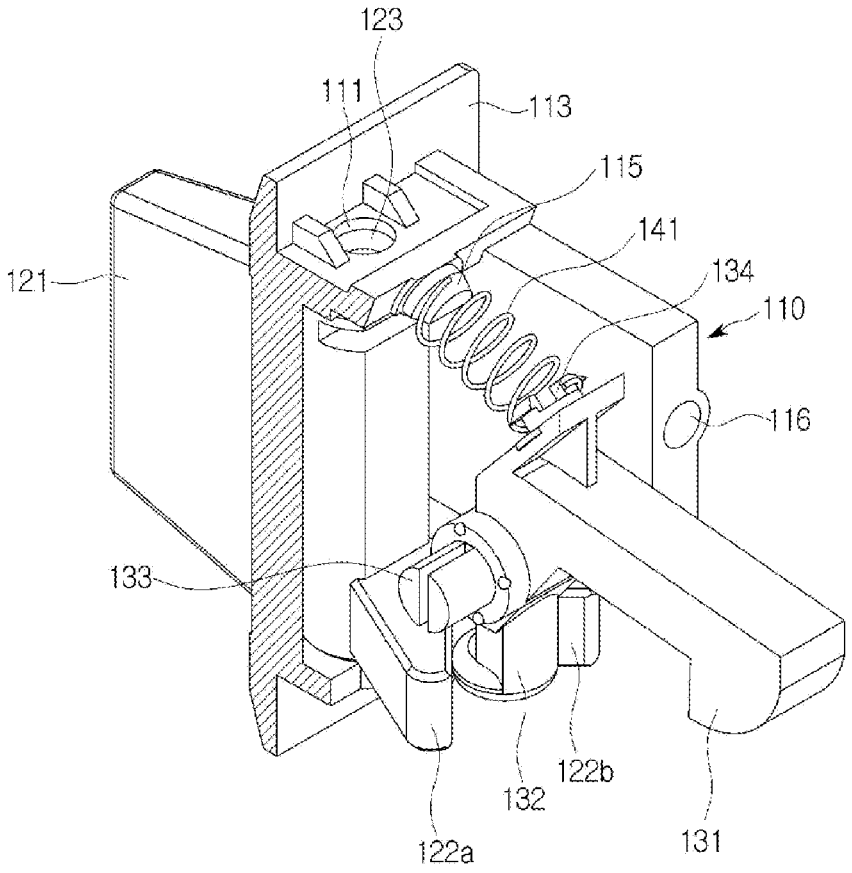
FIG. 8 is a rear upper cross-sectional perspective view of a state in which a locking member of the latch device illustrated in FIG. 7 is coupled to a fixing member.
Figure 9:
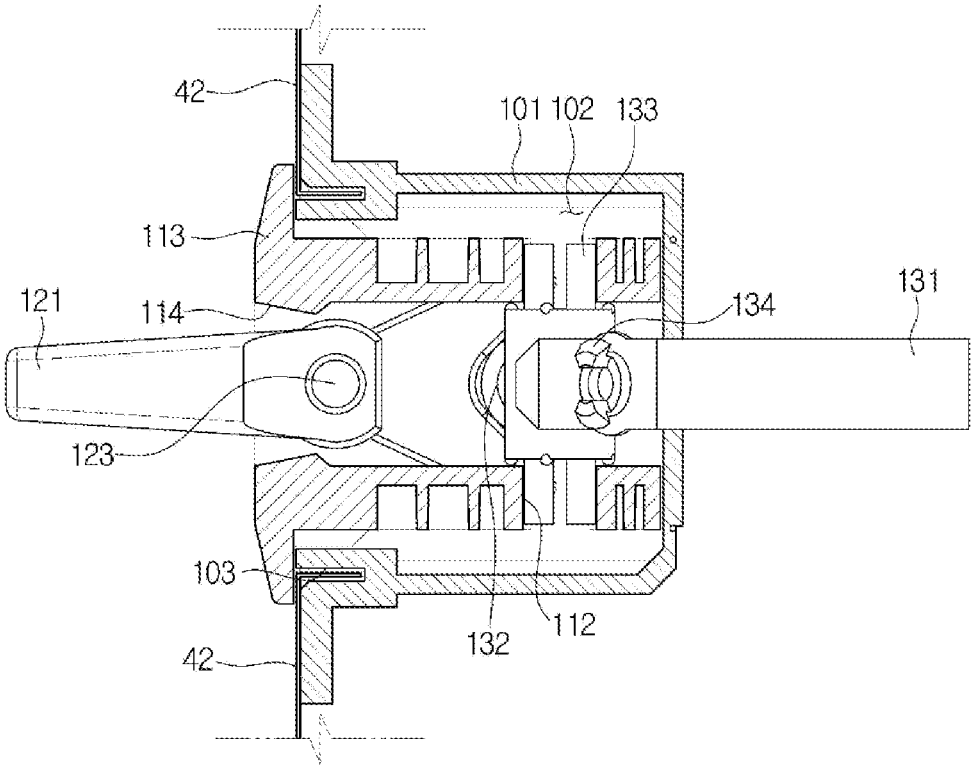
FIG. 9 illustrates a portion of the cross section taken along line A-A' in FIG. 4.

FIG. 4 illustrates a door device of the refrigerator 1 illustrated in FIG. 1. FIG. 5 illustrates a state in which the second door 42 of the door device 40 of the refrigerator 1 illustrated in FIG. 4 is opened. FIG. 6 is an exploded perspective view of a latch device 100 provided in the door device 40 illustrated in FIG. 4. FIG. 7 is a rear lower perspective view of a partial configuration of the latch device 100 illustrated in FIG. 6. FIG. 8 is a rear upper cross-sectional perspective view of a state in which a locking member 130 of the latch device 100 illustrated in FIG. 7 is coupled to a fixing member 106. FIG. 9 illustrates a portion of the cross section taken along line A-A' in FIG. 4.

Hereinafter, the latch device 100 provided in the door device 40 according to an embodiment of the present disclosure will be described in detail with reference to FIGS. 4 to 9.

Referring to FIGS. 4 to 9, the door device 40 may be provided with the latch device 100 configured to couple the second door 42 to the first door 41 or to separate the second door 42 from the first door 41. The latch device 100 may be disposed in the rear of the door handle 46 as illustrated in FIG. 1. The latch device 100 may be disposed to be covered by the door handle 46 when viewed from the front. The door handle 46 may be provided to have a width larger than that of the latch device 100. The door handle 46 may be disposed to be spaced apart from the latch device 100 by a predetermined distance. The user may drive the latch device 100 or grip the door handle 46 through a space between the door handle 46 and the latch device 100.

The latch device 100 may include the fixing member 106, a latch case 110, an input member 120, and the locking member 130. The fixing member 106 may be disposed on the first door 41. The latch case 110, the input member 120, and the locking member 130 may be disposed on the second door 42.

The fixing member 106 may be disposed on the other side opposite to one side of the first door 41 connected to the first hinge unit 61. The fixing member 106 may include a fixing protrusion 107 to which a locking protrusion 131 of the locking member 130 is selectively coupled. The fixing member 106 may include a fixing space 108 in which the locking protrusion 131 is accommodated.

The latch case 110 may be disposed on the other side opposite to one side of the second door 42 connected to the second hinge unit 62. The latch case 110 may rotatably support the input member 120. The latch case 110 may rotatably support the locking member 130.

The latch case 110 may include a first support hole 111 to rotatably support the input member 120 and a second support hole 112 to rotatably support the locking member 130.

A first shaft protrusion 123 of the input member 120 may be rotatably coupled to the first support hole 111. The first support hole 111 may support the input member 120 so that the input member 120 is rotatable with respect to a first rotation axis extending substantially in the up and down directions.

A second shaft protrusion 133 of the locking member 130 may be rotatably coupled to the second support hole 112. The second support hole 112 may support the locking member 130 so that the locking member 130 is rotatable with respect to a second rotation axis extending substantially in the left and right directions.

The first rotation axis may extend in a different direction from the second rotation axis. The first rotation axis may extend in a direction substantially perpendicular to the second rotation axis.

A latch cover 101 may be provided on the second door 42. The latch cover 101 may be installed at a portion of the second door 42 where the latch device 100 is installed. The latch cover 101 may include an accommodation space 102 in which at least a portion of the latch device 100 is accommodated. The latch cover 101 may include a door coupling portion 103 coupled to a portion of the second door 42.

The latch device 100 may be coupled to the latch cover 101 by a fixing member 151. Specifically, the latch case 110 may be inserted into the latch cover 101 in a state in which the input member 120 and the locking member 130 are mounted. The fixing member 151 may be coupled to a fixing hole (not shown) formed on the latch cover 101 and an insertion portion 116 formed on the latch case 110. Accordingly, the latch device 100 may be fixed to the latch cover 101. The fixing member 151 may be a screw. The fixing member 151 may be sequentially coupled to a fixing hole 42*a* formed on the rear surface of the second door 42, the fixing hole of the latch cover 101, and the insertion part 116 of the latch case 110. Accordingly, the latch device 100 may be fixed to the latch cover 101 and the second door 42.

Because the latch device 100 is fixed to the latch cover 101 and/or the second door 42 in a state in which the input member 120 and the locking member 130 are mounted on the latch case 110, the latch device 100 may be mounted relatively easily.

The latch case 110 may include a cover portion 113 to cover the accommodation space 102 of the latch cover 101. The cover portion 113 may be formed to cover a portion of the second door 42 to which the latch cover 101 is coupled. Specifically, referring to FIG. 9, a portion of the second door 42 may be bent, and the bent portion of the second door 42 may be inserted into the door coupling portion 103 of the latch cover 101. The cover portion 113 may extend to cover the bent portion of the second door 42 inserted into the latch cover 101. An outer appearance of the second door 42 may be improved by the cover portion 113.

The latch case 110 may include a through hole 114 through which an input portion 121 of the input member 120 passes. The through hole 114 may be formed on the cover portion 113. The through hole 114 may have a size and/or shape in consideration of rotational driving of the input member 120. The through hole 114 may be provided in a size in which a user may not see an internal configuration of the latch device 100. That is, the through hole 114 may be provided to correspond to a size and/or shape of the input portion 121.

The input member 120 may be coupled to the latch case 110 to be rotatable with respect to the second rotation axis. When rotating in a first direction, the input member 120 may rotate the locking member 130 in a direction in which the locking member 130 is separated from the fixing member 106. Even when rotating in a second direction opposite to the first direction, the input member 120 may also rotate the locking member 130 in the direction in which the locking member 130 is separated from the fixing member 106. The first direction may be set to the right direction, and the second direction may be set to the left direction.

The input member 120 may include a pressing part 122 configured to press the locking member 130 in the direction in which the locking member 130 is separated from the fixing member 106 when the input member 120 rotates. Referring to FIG. 7, the pressing part 122 may include a first pressing portion 122*a* and a second pressing portion 122*b*.

The first pressing portion 122*a* may be formed to press a receiving protrusion 132 of the locking member 130 when the input member 120 rotates to the right. The first pressing portion 122*a* may extend from the first shaft protrusion 123 of the input member 120 toward a rear right side. That is, the first pressing portion 122*a* may extend with a predetermined angle in the right direction with respect to the front and rear directions.

The second pressing portion 122*b* may be formed to press the receiving protrusion 132 of the locking member 130 when the input member 120 rotates to the left. The second pressing portion 122*b* may extend from the first shaft protrusion 123 of the input member 120 toward a rear left side. That is, the second pressing portion 122*b* may extend with a predetermined angle in the left direction with respect to the front and rear directions.

In other words, the pressing part 122 may include the first pressing portion 122*a* and the second pressing portion 122*b* extending from the first shaft protrusion 123 toward the rear right and left sides, respectively. The pressing part 122 may have a substantially alphabet "Y" shape.

The input member 120 may include the input portion 121 extending forward from the first shaft protrusion 123. The input portion 121 may be disposed to pass through the through hole 114. The input portion 121 may extend to protrude from a front surface of the second door 42. Accordingly, the user may easily operate the input portion 121.

The input member 120 may include the first shaft protrusion 123 forming a rotation axis. The first shaft protrusion 123 may be rotatably inserted into the first support hole 111 of the latch case 110. The first shaft protrusion 123 may substantially extend along the up and down directions.

The locking member 130 may be coupled to the latch case 110 to be rotatable with respect to the first rotation axis. The locking member 130 may include the second shaft protrusion 133 rotatably inserted into the second support hole 112 of the latch case 110. The second shaft protrusion 133 may extend substantially along the left and right directions.

The locking member 130 may be provided to be coupled to or separated from the fixing member 106. The locking member 130 may include the locking protrusion 131 formed at one end close to the fixing member 106 and the receiving protrusion 132 formed at the other end close to the input member 120.

The locking protrusion 131 may extend along the front and rear directions, and an end thereof may protrude substantially downward. The locking protrusion 131 may extend rearward from the second shaft protrusion 133. A protruding portion of the locking protrusion 131 may be caught on the fixing protrusion 107 of the fixing member 106. As the locking protrusion 131 is caught on the fixing protrusion 107, the second door 42 may be fixed to the first door 41.

The receiving protrusion 132 may extend substantially downward from the second shaft protrusion 133. The receiving protrusion 132 may extend along a direction substantially perpendicular to the locking protrusion 131. The receiving protrusion 132 may come into contact with the pressing part 122.

When the input member 120 rotates in the right direction, the receiving protrusion 132 may be rotated by being pressed by the first pressing portion 122*a*. In this case, the receiving protrusion 132 rotates rearward, and accordingly, the locking protrusion 131 rotates upward. As the locking protrusion 131 rotates upward, the locking protrusion 131 may be separated from the fixing member 106.

When the input member 120 rotates in the left direction, the receiving protrusion 132 may be rotated by being pressed by the second pressing portion 122*b*. In this case, the receiving protrusion 132 rotates rearward, and accordingly, the locking protrusion 131 rotates upward. As the locking protrusion 131 rotates upward, the locking protrusion 131 may be separated from the fixing member 106.

Referring to FIG. 8, the latch device 100 may further include an elastic member 141. One end of the elastic member 141 may be fixed to a first fixing portion 115 of the latch case 110, and the other end of the elastic member 141 may be fixed to a second fixing portion 134 of the locking member 130. The elastic member 141 may press the locking member 130 in a direction in which the locking member 130 is fixed to the fixing member 106. The elastic member 141 may be a spring.

Figure 10:
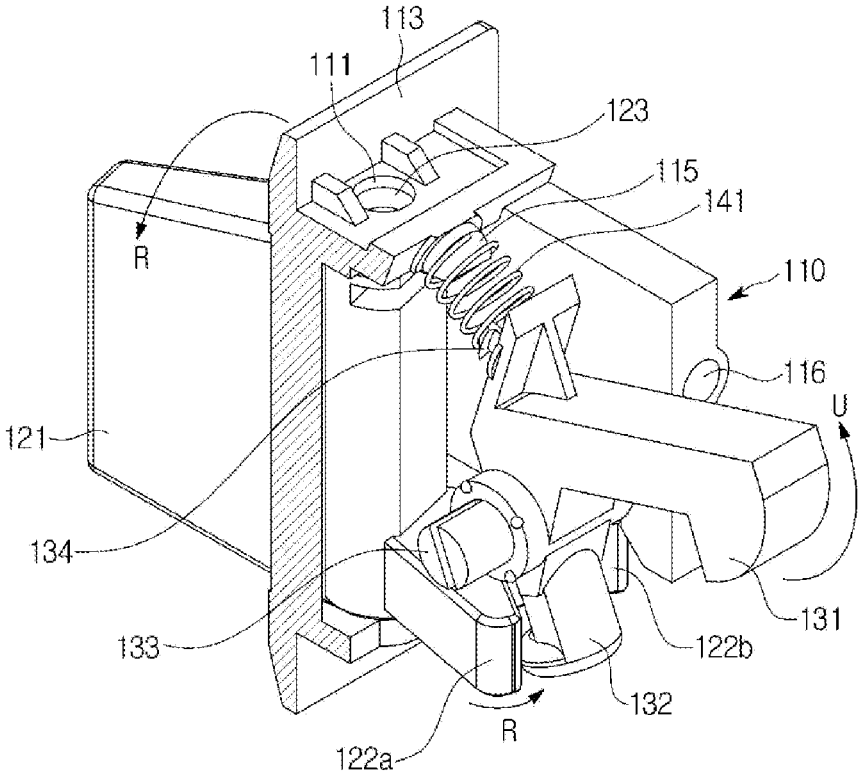
FIG. 10 is a rear upper cross-sectional perspective view of a state in which the locking member is separated from the fixing member as an input member of the latch device illustrated in FIG. 7 rotates to the right direction.
Figure 11:
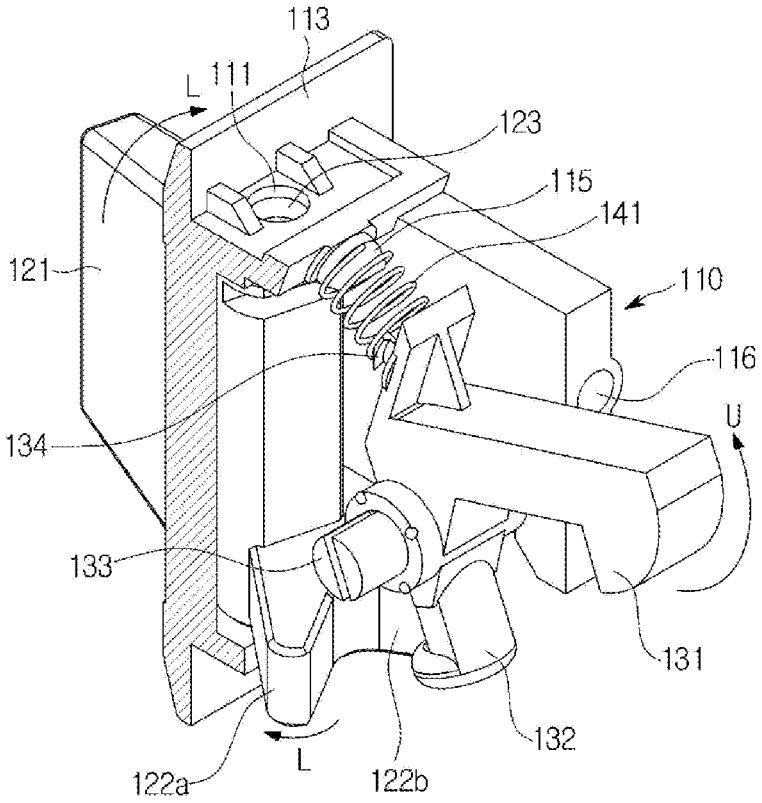
FIG. 11 is a rear upper cross-sectional perspective view of a state in which the locking member is separated from the fixing member as the input member of the latch device illustrated in FIG. 7 rotates to the left direction.

FIG. 10 is a rear upper cross-sectional perspective view of a state in which the locking member 130 is separated from the fixing member 106 as the input member 120 of the latch device 100 illustrated in FIG. 7 rotates to the right direction. FIG. 11 is a rear upper cross-sectional perspective view of a state in which the locking member 130 is separated from the fixing member 106 as the input member 120 of the latch device 100 illustrated in FIG. 7 rotates to the left direction.

Referring to FIG. 10, when the user rotates the input member 120 of the latch device 100 protruding from the front surface of the second door 42 in the first direction, that is, in the right direction (R direction), the first pressing portion 122*a* of the input member 120 rotates and may press the receiving protrusion 132. The pressed receiving protrusion 132 is pushed to the rear, and accordingly, the locking protrusion 131 of the locking member 130 rotates in the upward direction (U direction). As the locking protrusion 131 rotates, the locking protrusion 131 is separated from the fixing protrusion 107, and accordingly, the second door 42 is separated from the first door 41.

Referring to FIG. 11, when the user rotates the input member 120 of the latch device 100 protruding from the front surface of the second door 42 in the second direction, that is, in the left direction (L direction), the second pressing portion 122*b* of the input member 120 rotates and may press the receiving protrusion 132. The pressed receiving protrusion 132 is pushed to the rear, and accordingly, the locking protrusion 131 of the locking member 130 rotates in the upward direction (U direction). As the locking protrusion 131 rotates, the locking protrusion 131 is separated from the fixing protrusion 107, and accordingly, the second door 42 is separated from the first door 41.

Thereafter, when the user releases a force applied to the input portion 121 of the input member 120, the elastic member 141 rotates the locking protrusion 131 of the locking member 130 in the downward direction, the locking protrusion 131 is coupled to the fixing protrusion 107, and the pressing part 122 and the input portion 121 return to their original positions. Accordingly, the second door 42 may be fixed to the first door 41.

As such, because the latch device 100 according to an embodiment of the present disclosure may release the locking member 130 from the fixing member 106 not only when rotating the input member 120 in the right direction, but also when rotating the input member 120 in the left direction, the use of the latch device 100 is easy. In addition, because the latch device 100 according to an embodiment of the present disclosure may separate the second door 42 from the first door 41 regardless of the rotation direction, not only a normal right-handed user, but also a left-handed user may conveniently use the latch device 100. In addition, because the input portion 121 of the input member 120 of the latch device 100 protrudes from the front surface of the second door 42, the user may operate the input portion 121 even without gripping the door handle 46, so that the input portion 121 may be used even when the user holds an object in both hands, thereby increasing convenience of use.

Figure 12:
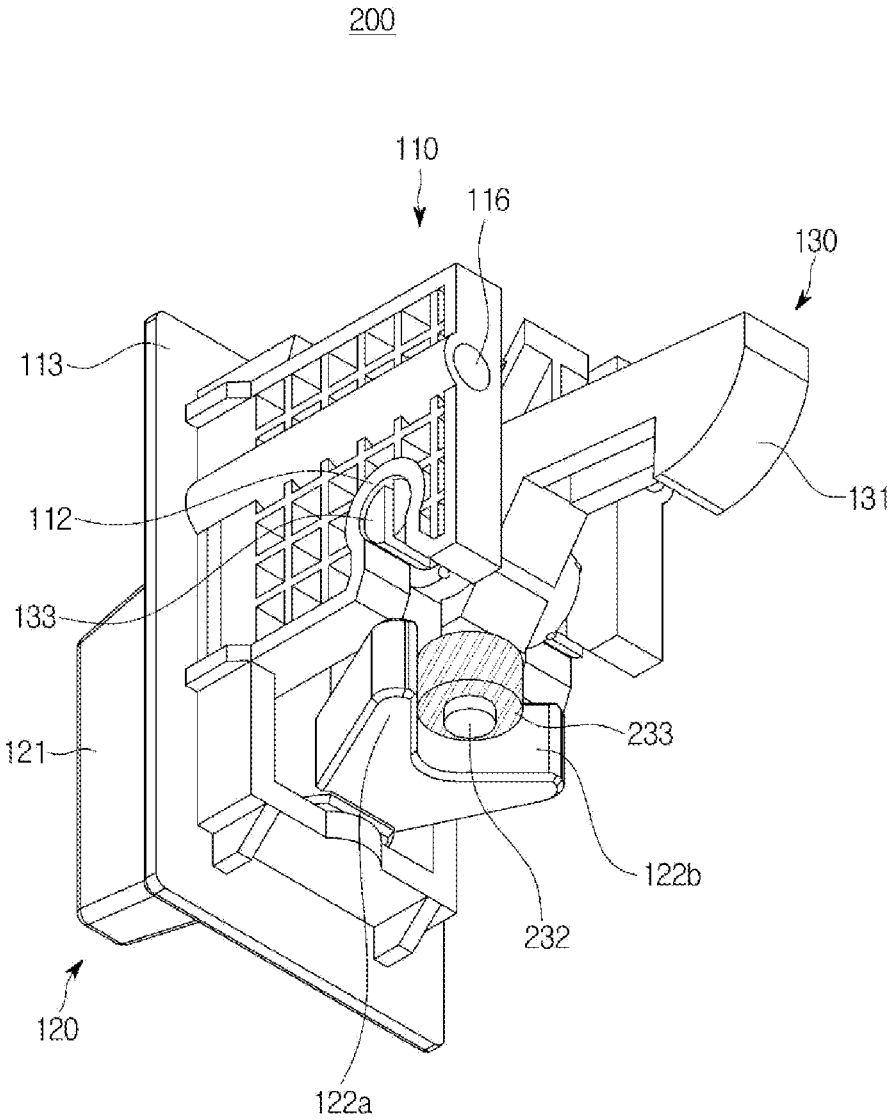
FIG. 12 illustrates a latch device according to an embodiment, which is different from the latch device illustrated in FIG. 7.

FIG. 12 illustrates a latch device according to another embodiment, which is different from the latch device 100 illustrated in FIG. 7.

In a description of a latch device illustrated in FIG. 12, the same reference numerals are assigned to the same components as those of the latch device 100 illustrated in FIGS. 1 to 11, and a description thereof may be omitted.

Referring to FIG. 12, the locking member 130 of a latch device 200 may include a receiving shaft 232 and a receiving roller 233 rotatably coupled to the receiving shaft 232, unlike the receiving protrusion 132 illustrated in FIGS. 1 to 11.

The receiving shaft 232 may extend substantially downward from the second shaft protrusion 133. The receiving shaft 232 may have a substantially cylindrical shape.

The receiving roller 233 may be rotatably coupled to the receiving shaft 232. The receiving roller 233 may be provided to come into contact with the first pressing portion 122*a* and the second pressing portion 122*b*.

According to this configuration, when the first pressing portion 122*a* or the second pressing portion 122*b* rotates the locking member 130 as the latch device 200 according to the embodiment illustrated in FIG. 12 rotates the input portion 121, the receiving roller 233 of the locking member 130 is rolled on the first pressing portion 122*a* or the second pressing portion 122*b*, so that a friction between the first and second pressing portions 122*a* and 122*b* and the locking member 130 may be reduced, thereby improving durability of the locking member 130.

Figure 13:
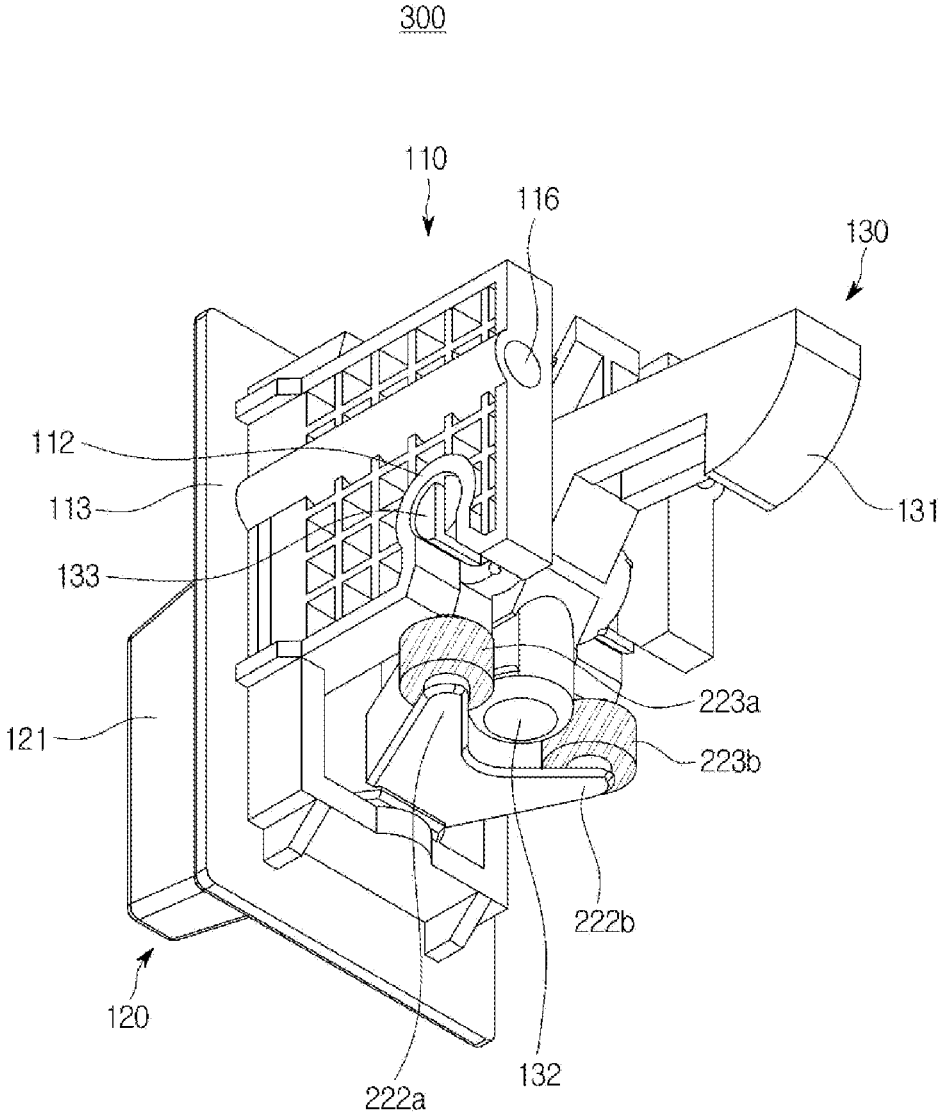
FIG. 13 illustrates a latch device according to another embodiment, which is different from the latch device illustrated in FIG. 7.

FIG. 13 illustrates a latch device according to another embodiment, which is different from the latch device 100 illustrated in FIG. 7.

In a description of a latch device 300 illustrated in FIG. 13, the same reference numerals are assigned to the same components as those of the latch device illustrated in FIGS. 1 to 11, and a description thereof may be omitted.

Referring to FIG. 13, the input member 120 of the latch device 300 may include a first roller support portion 222*a*, a first input roller 223*a*, a second roller support portion 222*b*, and a second input roller 223*b*, unlike the first pressing portion 122*a* and the second pressing portion 122*b* illustrated in FIGS. 1 to 11.

The first roller support portion 222*a* may extend from a rear end of the input portion 121 toward a rear right side. The first roller support part 222*a* may extend in a direction of being inclined at a predetermined angle to the right with respect to a direction in which the input portion 121 extends. The first input roller 223*a* may be rotatably coupled to an end of the first roller support 222*a*.

The second roller support portion 222*b* may extend from the rear end of the input portion 121 toward a rear left side. The second roller support part 222*b* may extend in a direction of being inclined at a predetermined angle to the left with respect to the direction in which the input portion 121 extends. The second input roller 223*b* may be rotatably coupled to an end of the second roller support 222*b*.

According to this configuration, when the first input roller 223*a* presses the receiving protrusion 132 as the latch device 300 according to the embodiment illustrated in FIG. 13 rotates the input portion 121, the first input roller 223*a* is rolled on the receiving protrusion 132, so that a friction between the first input roller 223*a* and the receiving protrusion 132 may be reduced, thereby improving durability of the input member 120.

Also, when the second input roller 223*b* presses the receiving protrusion 132 as the latch device 300 according to the embodiment illustrated in FIG. 13 rotates the input portion 121, the second input roller 223*b* is rolled on the receiving protrusion 132, so that a friction between the second input roller 223*b* and the receiving protrusion 132 may be reduced, thereby improving durability of the input member 120.

Figure 14:
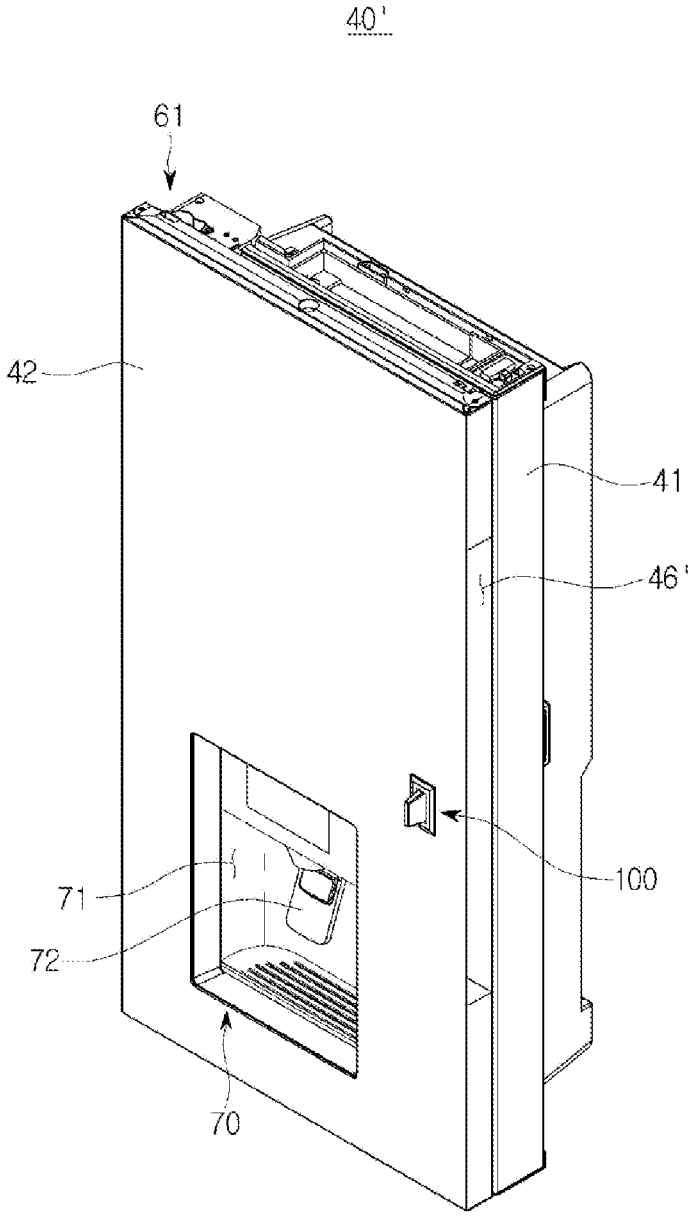
FIG. 14 illustrates a door device according to an embodiment, which is different from the door device illustrated in FIG. 4.

FIG. 14 illustrates a door device according to an embodiment, which is different from the door device 40 illustrated in FIG. 4.

In a description of a door device 40' illustrated in FIG. 14, the same reference numerals are assigned to the same components as those of the door device illustrated in FIGS. 1 to 11, and a description thereof may be omitted.

Referring to FIG. 14, a door handle 46' of the door device 40' according to another embodiment of the present disclosure does not have a shape protruding from the front surface of the second door 42 and extending in the up and down directions, but may have a groove shape extending in the up and down directions from a side surface of the second door 42. The user may open the second door 42 by putting his or her hand in an inner space of the door handle 46' and gripping the second door 42.

Like the door device 40' illustrated in FIG. 14, the latch device 100 according to an embodiment of the present disclosure may be applied to a door that does not have a shape of protruding from the front surface of the second door 42 like the door handle 46 illustrated in FIG. 1.

Figure 15:
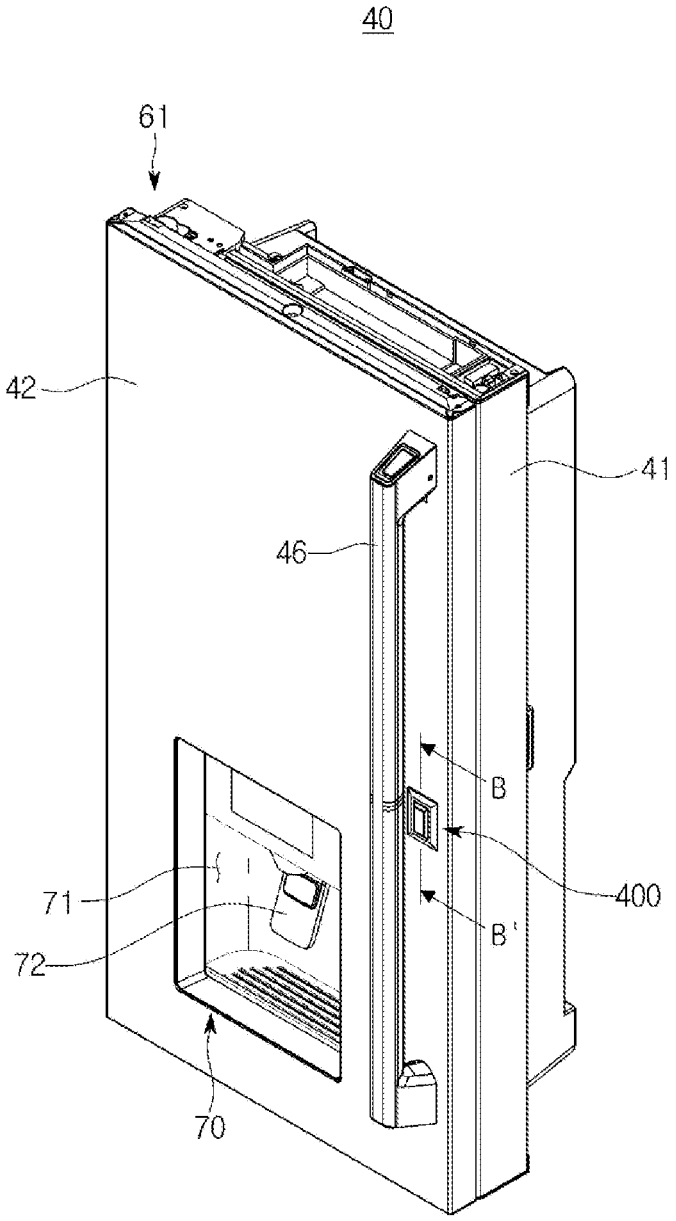
FIG. 15 illustrates a door device having a latch device according to another embodiment.
Figure 16:
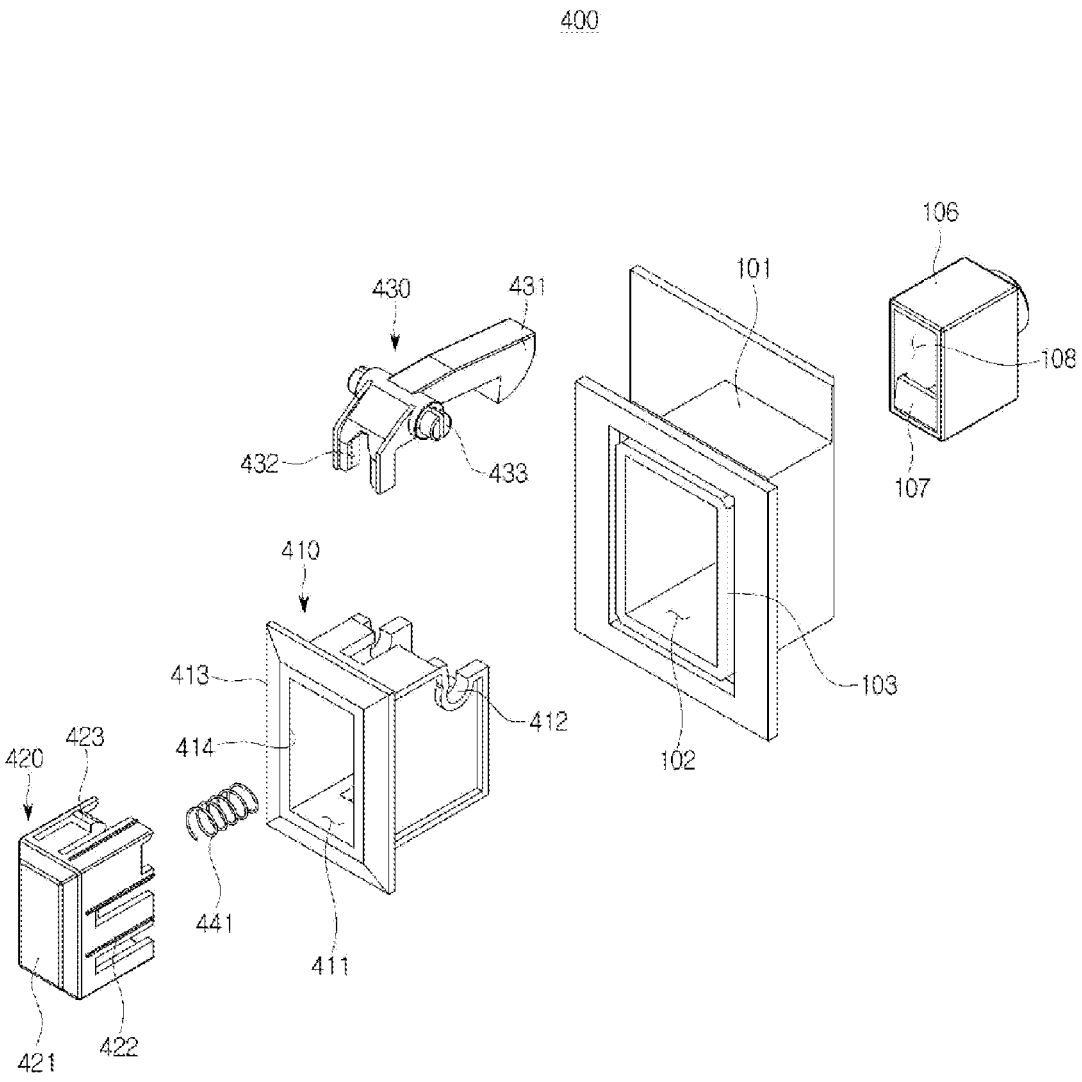
FIG. 16 is an exploded perspective view of the latch device illustrated in FIG. 15.
Figure 17:
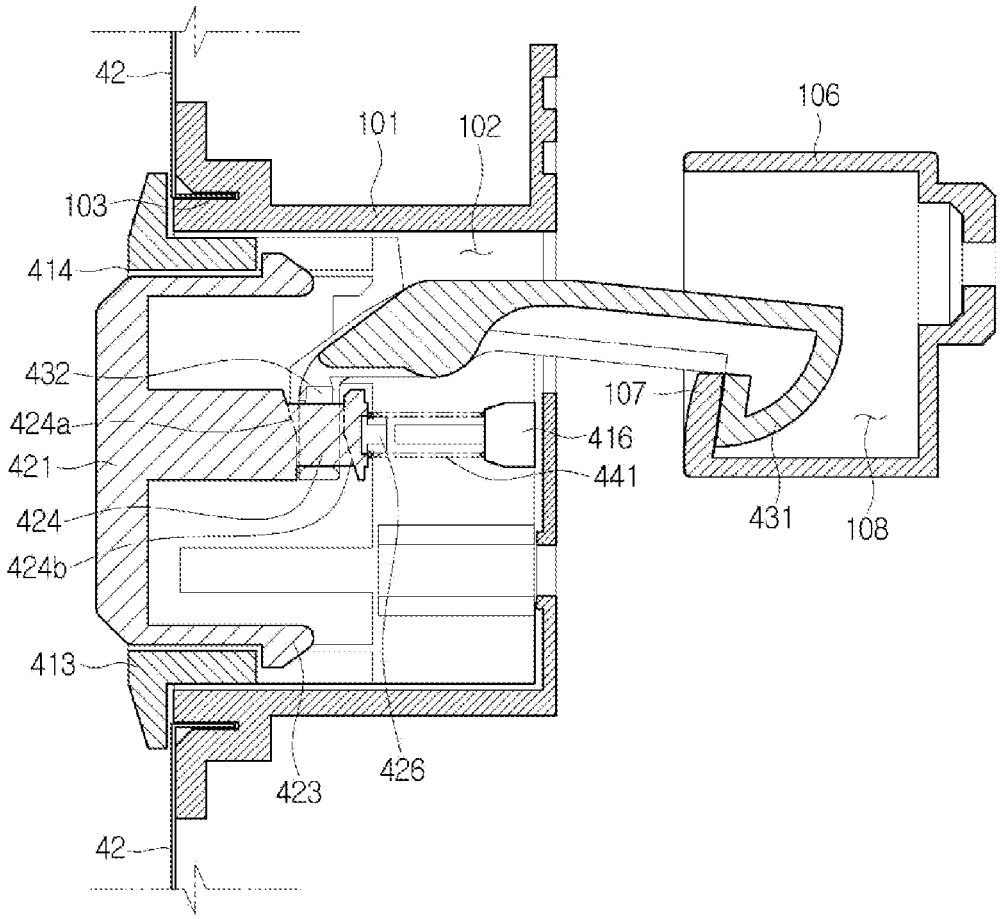
FIG. 17 illustrates a state in which a locking member is coupled to a fixing member, as a portion of the cross section taken along line B-B' in FIG. 15.
Figure 18:
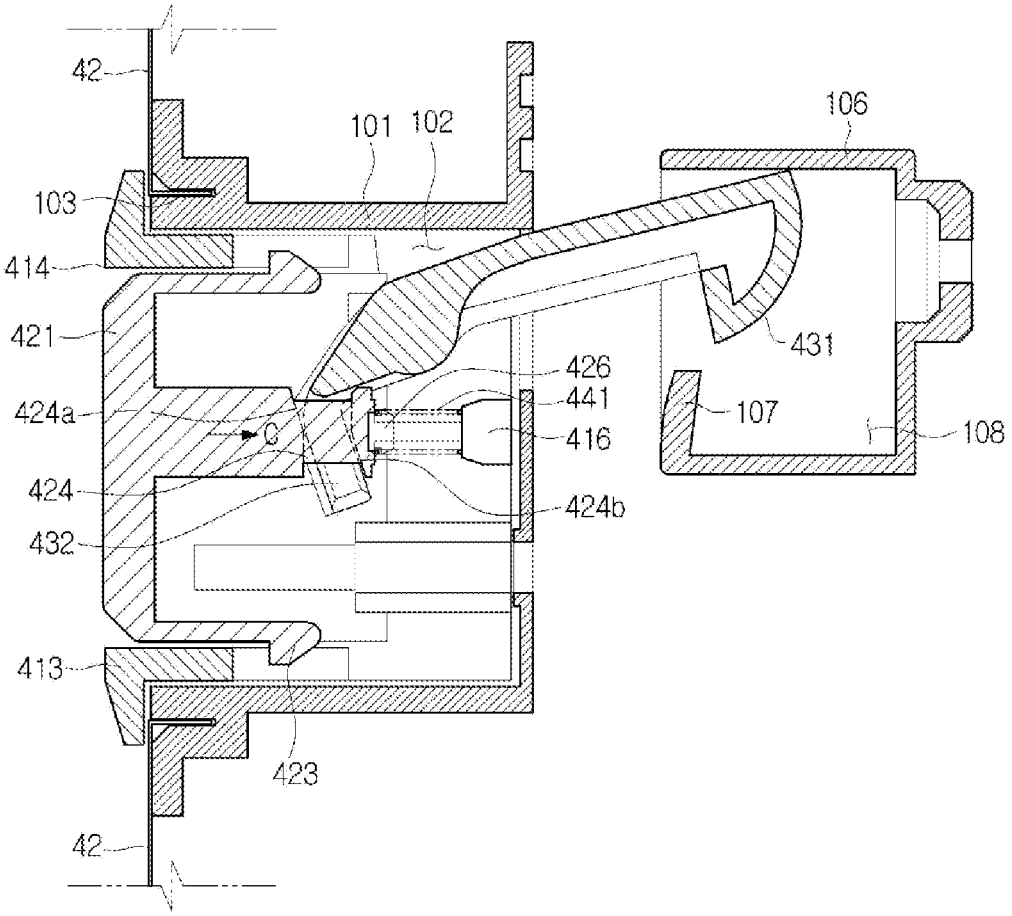
FIG. 18 illustrates a state in which the locking member is separated from the fixing member, as a portion of the cross section taken along line B-B' in FIG. 15.

FIG. 15 illustrates the door device 40 having a latch device 400 according to another embodiment. FIG. 16 is an exploded perspective view of the latch device 400 illustrated in FIG. 15. FIG. 17 illustrates a state in which a locking member 430 is coupled to the fixing member 106, as a portion of the cross section taken along line B-B' in FIG. 15. FIG. 18 illustrates a state in which the locking member 430 is separated from the fixing member 106, as a portion of the cross section taken along line B-B' in FIG. 15.

Referring to FIGS. 15 and 16, the latch device 400 may include the fixing member 106 installed on the first door 41, a latch case 410 installed on the second door 42, an input member 420, and the locking member 430. The latch cover 101 may be mounted on the second door 42. The configurations of the fixing member 106 and the latch cover 101 are the same as those illustrated in FIGS. 1 to 11, and thus a description thereof will be omitted.

The latch case 410 may include a movement space 411 in which the input member 420 is slidably coupled. The movement space 411 may be formed to substantially correspond to a size and/or shape of the input member 420.

The input member 420 may be slidably coupled to the movement space 411 of the latch case 410. The input member 420 may include an input portion 421 exposed to the outside of the second door 42 so that the user may operate the input portion 421.

Referring to FIGS. 17 and 18, the input member 420 may have a connection portion 424 connected to a receiving portion 432 of the locking member 430 to rotate the locking member 430. The connection portion 424 may extend rearward from the input portion 421 and may have a cross-section different from that of another portion to be inserted into a groove of the receiving portion 432.

The connection portion 424 may include a first inclined portion 424*a* and a second inclined portion 424*b* formed to correspond to a rotation range of the receiving portion 432 in consideration of the rotation of the receiving portion 432.

The first inclined portion 424*a* may be formed to be inclined at a predetermined angle forward from a surface on which the input member 420 presses the receiving portion 432. The second inclined portion 424*b* may be formed to be inclined at a predetermined angle rearward from a surface on which the input member 420 pulls the receiving portion 432.

The input member 420 may include a rib 422 extending along a sliding movement direction and protruding from an outer surface thereof facing the latch case 410. The rib 422 may improve durability of the latch case 410 and the input member 420 by reducing a friction between the input member 420 and the latch case 410 and may allow the input member 420 to smoothly slide.

The input member 420 may include a limiting protrusion 423 configured to limit a range in which the input member 420 is withdrawn from the latch case 410. The limiting protrusion 423 may protrude to be interfered by an inner surface of the latch case 410. FIGS. 17 and 18 illustrate that the limiting protrusions 423 are provided on upper and lower sides of the input member 420, respectively, but are not limited thereto, and the limiting protrusion 423 may be provided on the left side and/or the right side of the input member 420 as well.

The locking member 430 may be coupled to the latch case 110 to be rotatable with respect to the first rotation axis. The locking member 430 may include a shaft protrusion 433 rotatably inserted into a support hole 412 of the latch case 110.

The locking member 430 may include a locking protrusion 431 provided to be coupled to or separated from the fixing member 106. The locking protrusion 431 may extend rearward from the shaft protrusion 433, and an end thereof may protrude downward.

The locking member 430 may include the receiving portion 432 extending substantially downward from the shaft protrusion 433.

The latch device 400 may include an elastic member 441 provided to press the input member 420 in a withdrawal direction. One end of the elastic member 441 may be fixed to a first fixing portion 426 of the input member 420, and the other end of the elastic member 441 may be fixed to a second fixing portion 416 of the latch case 410. The input portion 421 may protrude only by a predetermined length from the front surface of the second door 42 by the elastic member 441 and the limiting protrusion 423.

The elastic member 441 may be disposed in a substantially central portion on a plane perpendicular to a sliding direction of the input member 420. According to this arrangement of the elastic member 441, when the input member 420 slides, the input member 420 is not biased in any one of up, down, left, and right directions, so that a friction between an inner surface of the latch case 410 and the input member 420 may be reduced.

Referring to FIG. 17, when the second door 42 is fixed to the first door 41, the locking protrusion 431 is coupled to the fixing protrusion 107, the elastic member 441 presses the input member 120 in the withdrawal direction, and the limiting protrusion 423 may be interfered by the inner surface of the latch case 410 so that the input member 420 is not separated from the latch case 410.

Referring to FIG. 18, when the user presses the input member 420 of the latch device 400 protruding from the front surface of the second door 42 to move the input member 420 in a C direction, one surface of the connection portion 424 of the input member 420 may press the receiving portion 432. Accordingly, the locking member 430 rotates with respect to the shaft protrusion 433, and the locking protrusion 431 is separated from the fixing protrusion 107. A front surface of the receiving portion 432 comes into contact with the first inclined portion 424*a*, and a rear surface of the receiving portion 432 comes into contact with the second inclined portion 424*b*. The elastic member 441 is contracted. Accordingly, the second door 42 is separated from the first door 41.

When the user releases a force applied to the input member 120, the elastic member 441 moves the input member 120 in the withdrawal direction, and the locking protrusion 431 is coupled to the fixing protrusion 107. Accordingly, the second door 42 is fixed to the first door 41.

As such, because the input portion 421 of the input member 420 of the latch device 400 according to an embodiment of the present disclosure protrudes from the front surface of the second door 42, the user may operate the input portion 121 even without gripping the door handle 46, so that the input portion 121 may be used even when the user holds an object in both hands, thereby increasing convenience of use.

Figure 19:
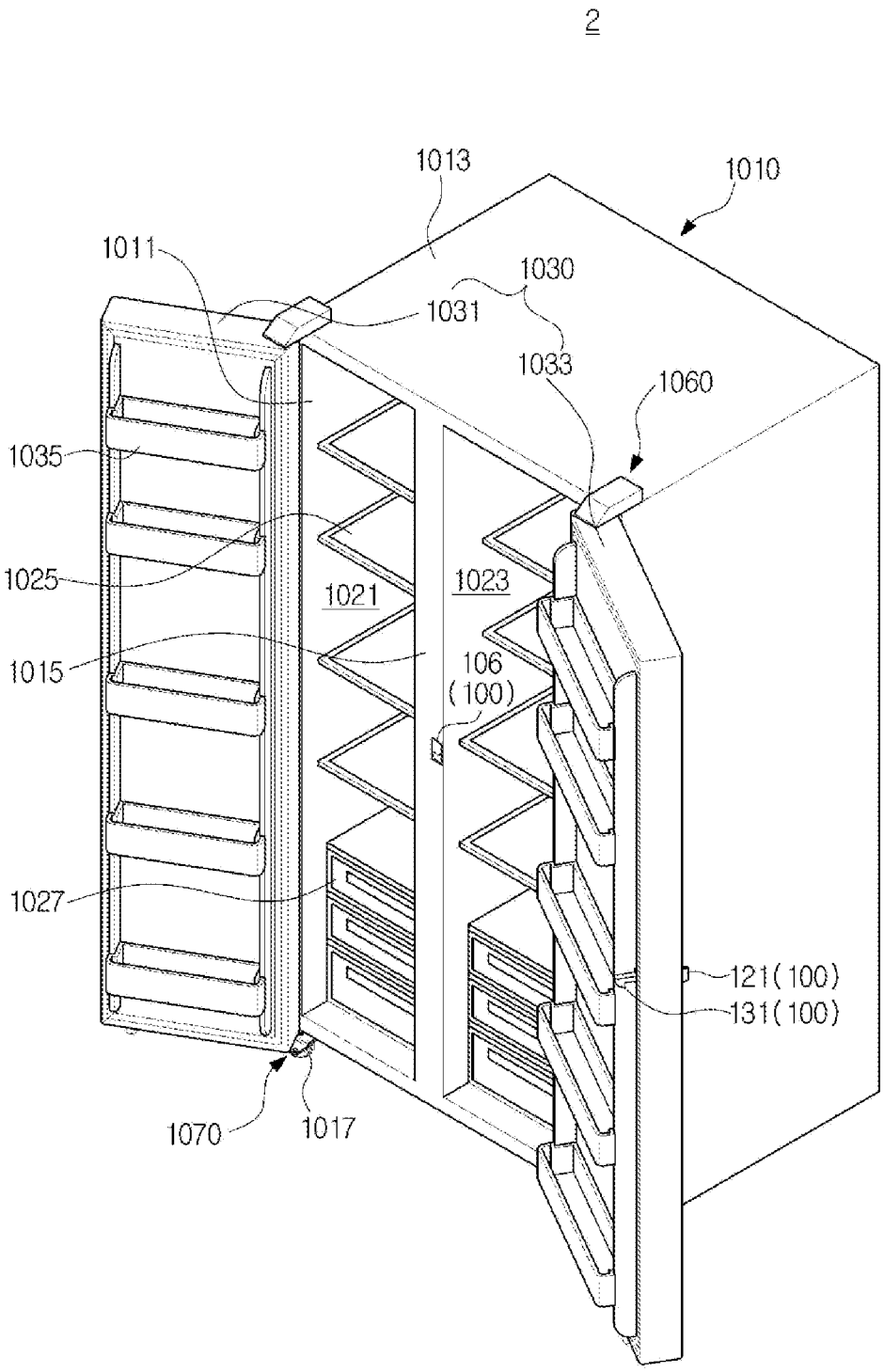
FIG. 19 illustrates a refrigerator according to another embodiment of the present disclosure.

FIG. 19 illustrates a refrigerator 2 according to another embodiment of the present disclosure.

In a description of the refrigerator 2 illustrated in FIG. 19, the same reference numerals are assigned to the same components as those of the refrigerator illustrated in FIGS. 1 to 11, and a description thereof may be omitted.

Referring to FIG. 19, the latch device 100 illustrated in FIGS. 1 to 11 may be applied to the side-by-side type refrigerator 2 having a single door 1030.

As illustrated in FIG. 19, the refrigerator 2 may include a main body 1010, storage compartments 1021 and 1023 provided inside the main body 1010 and having an open front side, and a door 1030 rotatably coupled to the main body 1010 to open and close the storage compartments 1021 and 1023.

The main body 1010 may include an inner case 1011 forming the storage compartments 1021 and 1023, an outer case 1013 forming an outer appearance, a cold air supply device (not shown) configured to supply cold air to the storage compartments 1021 and 1023, a partition 1015 configured to partition the storage compartments 1021 and 1023 in the left and right directions, and a support member 1017 configured to support the main body 1010.

The support member 1017 configured to support the main body 1010 may be coupled to a lower rear portion of the main body 1010 and a lower portion of a lower hinge 1070 coupled to a lower front portion of the main body 1010.

The cold air supply device may include a compressor, a condenser, an expansion valve, an evaporator, a blowing fan, a cold air duct, and the like, and an insulator (not shown) is foamed between the inner case 1011 and outer case 1013 of the main body 1010 to prevent cold air to leak from the storage compartment 20.

A machine compartment (not shown) in which a compressor and a condenser for compressing a refrigerant and condensing the compressed refrigerant are installed is provided at a lower rear side of the main body 1010.

The storage compartments 1021 and 1023 are partitioned left and right by the partition 1015, the refrigerating compartment 1021 is provided on the right side of the main body 1010, and the freezing compartment 1023 is provided on the left side of the main body 1010.

Although the drawing illustrates that the refrigerating compartment 1021 is provided on the right side of the main body 1010 and the freezing compartment 1023 is provided on the left side of the main body 1010 by the partition 1015, the freezing compartment 1023 may be provided on the right side of the main body 1010 and the refrigerating compartment 1021 may be provided on the left side of the main body 1010.

Each of the storage compartments 1021 and 1023 is provided with a plurality of shelves 1025 so that each of the storage compartments 1021 and 1023 including the refrigerating compartment 1021 and the freezing compartment 1023 may have a plurality of storage spaces, and a plurality of storage containers 1027 to store food and the like may be disposed at a lower portion of the storage compartment 1021.

Although the drawing illustrates that a plurality of the shelves 1025 and a plurality of the storage containers 1027 are provided in both the refrigerating compartment 1021 and the freezing compartment 1023, the plurality of shelves 1025 and storage containers 1027 may be provided in only one of the refrigerating compartment 1021 and the freezing compartment 1023.

The refrigerating compartment 1021 and the freezing compartment 1023 are opened and closed by a refrigerating compartment door 1031 and a freezing compartment door 1033 that are rotatably coupled to the main body 1010, respectively, and an upper hinge 1060 and the lower hinge 1070 are coupled to upper and lower portions of the main body 1010, respectively, so that the refrigerating compartment door 1031 and the freezing compartment door 1033 are rotatably coupled to the main body 1010.

A plurality of door guards 1035 configured to store food and the like may be provided on rear surfaces of the refrigerating compartment door 1031 and the freezing compartment door 1033. Although the drawing illustrates that a plurality of the door guards 1035 is provided on the rear surfaces of the refrigerating compartment door 1031 and the freezing compartment door 1033, respectively, the plurality of door guards 1035 may be provided on only one of the refrigerating compartment door 1031 and the freezing compartment door 1033.

The fixing member 106 of the latch device 100 may be installed on the partition 1015 of the main body 1010.

The latch device 100 may be installed such that the input portion 121 protrudes from a front surface of the freezing compartment door 1033 and the locking protrusion 131 protrudes from the rear surface of the freezing compartment door 1033.

According to this configuration, the freezing compartment door 1033 may be fixed to the main body 1010 or separated from the main body 1010. That is, when the freezing compartment door 1033 is closed, the locking protrusion 131 may be fixed to the fixing member 106. When the user rotates the input portion 121 in the left or right direction, the locking protrusion 131 is released from the fixing member 106, and the freezing compartment door 1033 may be separated from the main body 1010.

FIG. 19 illustrates that the latch device 100 is disposed only on the freezing compartment door 1033, but is not limited thereto, the latch device 100 may also be disposed on the refrigerating compartment door 1031.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator, comprising:

a main body including a storage compartment;

a first door disposed in front of the main body and having an opening;

a second door disposed in front of the first door to open and close the opening of the first door; and a latch device configured to couple or separate the second door to or from the first door, wherein the latch device includes:

a fixing member disposed on the first door, a locking member disposed on the second door to be coupled to or separated from the fixing member, and an input member disposed on the second door to be rotatable in first and second directions, and wherein the locking member rotates in a direction to separate the locking member from the fixing member when the input member rotates in the first direction, and the locking member rotates in the direction to separate the locking member from the fixing member when the input member rotates in the second direction.

2. The refrigerator according to claim 1, wherein:

the latch device further includes a latch case disposed on the second door, the locking member is coupled to the latch case to be rotatable with respect to a first rotation axis; and the input member is coupled to the latch case to be rotatable with respect to a second rotation axis.

3. The refrigerator according to claim 2, wherein the latch device further includes an elastic member configured such that one end of the elastic member is fixed to the latch case and another end of the elastic member is fixed to the locking member to press the locking member in a direction of being coupled to the fixing member.

4. The refrigerator according to claim 2, wherein the second door further includes a latch cover forming an accommodation space in which at least a portion of the latch case is accommodated.

5. The refrigerator according to claim 4, wherein the latch case includes a cover portion to cover the accommodation space of the latch cover.

6. The refrigerator according to claim 5, wherein the cover portion is formed to cover a portion of the second door to which the latch cover is coupled.

7. The refrigerator according to claim 6, wherein the cover portion includes a through hole formed in a size and shape corresponding to the input member so that the input member passes therethrough.

8. The refrigerator according to claim 4, wherein the latch case is disposed to be screwed to at least one of the latch cover and the second door.

9. The refrigerator according to claim 2, wherein the first rotation axis extends in a direction different from the second rotation axis.

10. The refrigerator according to claim 9, wherein the first rotation axis extends in a direction perpendicular to the second rotation axis.

11. The refrigerator according to claim 1, wherein:

the locking member includes a locking protrusion formed at one end of the locking member adjacent to the fixing member and a receiving protrusion formed at another end of the locking member adjacent to the input member, and the input member includes a first pressing portion configured to press the receiving protrusion when the input member rotates in the second direction and a second pressing portion configured to press the receiving protrusion when the input member rotates in the first direction.

12. The refrigerator according to claim 11, wherein the receiving protrusion includes a receiving roller rotatably disposed on a portion of the receiving protrusion to contact the first pressing portion or the second pressing portion.

13. The refrigerator according to claim 11, wherein at least one of the first pressing portion and the second pressing portion includes an input roller rotatably disposed on a portion of the at least one of the first pressing portion and the second pressing portion to contact the receiving protrusion when the input member rotates.

14. The refrigerator according to claim 1, further comprising a door handle installed on the second door and disposed in front of the latch device to be spaced apart from the latch device.

15. The refrigerator according to claim 1, wherein the input member is disposed to protrude from a front surface of the second door.

16. The refrigerator according to claim 1, wherein a portion of the input member protrudes from a front surface of the second door to receive a rotational force in the first and second directions directly from a user to rotate the portion of the input member in the first and second directions.

17. The refrigerator according to claim 1, wherein the input member is configured such that rotation of the input member in the first direction causes the locking member to rotate in the direction to separate the locking member from the fixing member, and the input member is configured such that rotation of the input member in the second direction causes the locking member to rotate in the direction to separate the locking member from the fixing member.

18. A refrigerator, comprising:

a main body including a storage compartment;

a first door disposed in front of the main body and having an opening;

a second door disposed in front of the first door to open and close the opening of the first door; and a latch device configured to couple or separate the second door to or from the first door, wherein the latch device includes:

a fixing member disposed on the first door, a locking member disposed on the second door to be coupled to or separated from the fixing member, and an input member disposed on the second door to be rotatable in first and second directions, and wherein the locking member rotates in a direction to separate the locking member from the fixing member when the input member rotates in the first direction, the locking member rotates in the direction to separate the locking member from the fixing member when the input member rotates in the second direction, the locking member includes a locking protrusion formed at one end of the locking member adjacent to the fixing member and a receiving protrusion formed at another end of the locking member adjacent to the input member, wherein the receiving protrusion includes a receiving roller rotatably disposed on a portion of the receiving protrusion, and the input member includes a first pressing portion configured to contact the receiving roller when the input member rotates in the second direction and a second pressing portion configured to contact the receiving roller when the input member rotates in the first direction.

19. A refrigerator, comprising:

a main body including a storage compartment;

a first door disposed in front of the main body and having an opening;

a second door disposed in front of the first door to open and close the opening of the first door; and a latch device configured to couple or separate the second door to or from the first door, wherein the latch device includes:

a fixing member disposed on the first door, a locking member disposed on the second door to be coupled to or separated from the fixing member, and an input member disposed on the second door to be rotatable in first and second directions, and wherein the locking member rotates in a direction to separate the locking member from the fixing member when the input member rotates in the first direction, the locking member rotates in the direction to separate the locking member from the fixing member when the input member rotates in the second direction, the locking member includes a locking protrusion formed at one end of the locking member adjacent to the fixing member and a receiving protrusion formed at another end of the locking member adjacent to the input member, the input member includes a first pressing portion configured to contact the receiving roller when the input member rotates in the second direction and a second pressing portion configured to contact the receiving roller when the input member rotates in the first direction, and at least one of the first pressing portion and the second pressing portion includes an input roller rotatably disposed on a portion of the at least one of the first pressing portion and the second pressing portion to contact the receiving protrusion when the input member rotates.

20. A refrigerator, comprising:

a main body including a storage compartment;

a first door disposed in front of the main body and having an opening;

a second door disposed in front of the first door to open and close the opening of the first door; and a latch device configured to couple or separate the second door to or from the first door, wherein the latch device includes:

a fixing member disposed on the first door, a locking member disposed on the second door to be coupled to or separated from the fixing member, and an input member disposed on the second door to be rotatable about a first rotation axis in first and second directions, and wherein the locking member rotates about a second rotation axis, which extends in a direction different from the first rotation axis, in a direction to separate the locking member from the fixing member when the input member rotates in the first direction, and the locking member rotates about the second rotation axis in the direction to separate the locking member from the fixing member when the input member rotates in the second direction.

* * * * *